US010383493B2

(12) United States Patent
Tahara

(10) Patent No.: US 10,383,493 B2
(45) Date of Patent: Aug. 20, 2019

(54) DUST COLLECTOR

(71) Applicant: MAKITA CORPORATION, Anjo-shi (JP)

(72) Inventor: Takayuki Tahara, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 315 days.

(21) Appl. No.: 15/166,504

(22) Filed: May 27, 2016

(65) Prior Publication Data

US 2017/0007085 A1 Jan. 12, 2017

(30) Foreign Application Priority Data

Jul. 9, 2015 (JP) ..... 2015-138002
Nov. 25, 2015 (JP) ..... 2015-229399

(51) Int. Cl.
*A47L 5/36* (2006.01)
*A47L 9/28* (2006.01)
(Continued)

(52) U.S. Cl.
CPC ..... *A47L 5/36* (2013.01); *A47L 9/24* (2013.01); *A47L 9/2842* (2013.01);
(Continued)

(58) Field of Classification Search
CPC . A47L 5/36; A47L 9/24; A47L 9/2842; A47L 9/2857; A47L 9/2884; A47L 9/30; A47L 9/327
See application file for complete search history.

(56) References Cited

U.S. PATENT DOCUMENTS 3,328,820 A * 7/1967 Doersam ..... A47L 11/4061 15/324
4,594,807 A * 6/1986 McQueen ..... A01M 1/08 15/339
(Continued)

FOREIGN PATENT DOCUMENTS

JP H0670872 A 3/1994
JP H0751200 A 2/1995
(Continued)

OTHER PUBLICATIONS

Office Action from the Japanese Patent Office dated May 7, 2019 in counterpart Japanese application No. 2015-229399, and translation thereof.
(Continued)

*Primary Examiner* — Robert J Scruggs
(74) *Attorney, Agent, or Firm* — J-Tek Law PLLC; Jeffrey D. Tekanic; Scott T. Wakeman

(57) ABSTRACT

A dust collector includes a dust-collector main body, a coupling-hose part, an operation unit, and a belt or harness. The dust-collector main body serves to collect dust by generating a suction draft (partial vacuum). The dust-collector main body includes a housing, a motor, a dust-collection chamber, and at least one battery pack mount. The belt or harness is attached to the dust-collector main body and is designed for the user to carry the dust-collector main body on his or her back. The operation unit is connected to the dust-collector main body via an external, flexible cord. The operation unit includes one or more LEDs for illuminating the area to be cleaned and an ON/OFF switch for controlling operation of the motor.

19 Claims, 33 Drawing Sheets

(51) Int. Cl.
*A47L 9/24* (2006.01)
*A47L 9/30* (2006.01)
*A47L 9/32* (2006.01)

(52) U.S. Cl.
CPC ..... *A47L 9/2857* (2013.01); *A47L 9/2884* (2013.01); *A47L 9/30* (2013.01); *A47L 9/327* (2013.01)

(56) References Cited

U.S. PATENT DOCUMENTS 6,295,692 B1 * 10/2001 Shideler ..... A47L 5/14 15/327.5
6,568,026 B2 * 5/2003 Roy ..... A47L 5/36 15/323
8,354,183 B2 1/2013 Konuma et al.
8,733,470 B2 * 5/2014 Matthias ..... B25F 5/02 173/170
8,842,427 B2 9/2014 Yoshimura et al.
9,456,722 B2 * 10/2016 Tomasiak ..... A47L 5/365
2005/0155177 A1 * 7/2005 Baer ..... A47L 5/365 15/353
2006/0005346 A1 * 1/2006 Rupp ..... A47L 5/36 15/327.5
2007/0174992 A1 * 8/2007 Murray ..... A47L 5/36 15/326
2010/0062326 A1 3/2010 Konuma et al.
2012/0251229 A1 10/2012 Liang et al.
2014/0079973 A1 3/2014 Liang et al.
2016/0293912 A1 * 10/2016 Manion ..... B25F 5/02

FOREIGN PATENT DOCUMENTS

JP 2001169974 A 6/2001
JP 2002224631 A 8/2002
JP 2002320573 A 11/2002
JP 2002320579 A 11/2002
JP 2006305248 A 11/2006
JP 2010178773 A 8/2010
JP 2011244724 A 12/2011
JP 2011244780 A 12/2011
JP 2013192867 A 9/2013
JP 2014008303 A 1/2014
JP 2014155862 A 8/2014
JP 2015084810 A 5/2015
JP 2015091500 A 5/2015

OTHER PUBLICATIONS

Search report from the Japanese Patent Office dated Apr. 25, 2019 in counterpart Japanese application No. 2015-229399, and machine translation thereof.

* cited by examiner

DUST COLLECTOR

CROSS-REFERENCE

This application claims priority to Japanese patent application serial number 2015-138002, filed on Jul. 9, 2015, and to Japanese patent application serial number 2015-229399, filed on Nov. 25, 2015, the contents of both of which are incorporated herein by reference in their entireties.

TECHNICAL FIELD

The present invention generally relates to a dust collector or vacuuming apparatus (vacuum cleaner) used in cleaning, e.g., vacuuming.

BACKGROUND ART

Dust collectors may be used in cleaning to vacuum dust and other particles from floors, stairs, furniture, etc., and are also known as vacuum cleaners. Some dust collectors (vacuum cleaners) comprise a dust-collector main body (canister), which generates a suction draft (partial vacuum), and a coupling-hose part (flexible hose and wand), which is coupled to the dust-collector main body. Such dust collectors are also known as canister vacuum cleaners. The tip of the coupling-hose part (wand) is typically detachably coupled to a nozzle part (e.g., a vacuuming attachment, such as a crevice tool, floor nozzle, dusting brush, floor brush, nozzle, etc.). A motor and a fan, which generate the suction draft, are located in the dust-collector main body. A dust-collection chamber for collecting suctioned-in dust is also provided or defined in the dust-collector main body. Owing to the internal motor, dust-collection chamber, and the like, such a dust-collector main body is typically heavy and burdensome to carry by hand. Consequently, known dust collectors typically have castors that are attached to a lower part of the dust-collector main body so that the dust-collector main body can be dragged along the floor, as shown in, e.g., Japanese Laid-open Patent Publication 2014-155862.

SUMMARY OF THE INVENTION

The heavy weight and large size of the dust-collector main body can make cleaning with such a dust collector (canister vacuum cleaner) tiring and cumbersome. For example, when cleaning stairs, there is often no space to place a dust-collector main body. Consequently, the heavy dust-collector main body must be carried by hand while vacuuming stairs. In view of this circumstance, efforts have been made to reduce the weight of the dust-collector main body, but weight reductions often lead to a reduction in the suction force of the dust collector because it is necessary to decrease the weight (and thus suctioning power) of the internal motor.

It is one non-limiting object of the present teachings to disclose a dust collector used for cleaning (vacuuming) that enables a user to conveniently perform the cleaning work (vacuuming) without having to carry a heavy component (such as the dust-collector main body) by hand while still enabling cleaning (vacuuming) with high-power suctioning.

In one aspect of the present teachings, a back-carried dust collector may comprise: a housing (canister) comprising a motor and a dust-collection part (chamber) that collects dust when the motor is driven; a battery-holding part (battery pack mount) provided on the housing such that the battery-holding part is capable of holding a slide-mountable power-tool battery (battery pack); and shoulder belts (harness) that are slung over both shoulders of a user in order to carry the housing on the user's back. Such a back-carried dust collector makes it possible for the user to vacuum without having to carry a heavy component (canister) by hand while utilizing a high-power motor to clean (vacuum) with high-power suctioning.

In such a back-carried dust collector, the battery-holding part may be disposed in or on a downward portion of the housing. In addition or in the alternative, an air-exhaust port, which directs an exhaust draft downward, may be provided in a lower part of the housing. In addition or in the alternative, a switch for driving (turning ON and OFF) the motor and a (flexible) cord extending from the switch may be provided and one end of the cord may be physically connected to a lower part of the housing.

In addition or in the alternative, the housing may have: a rear-surface side, which is proximate to a back side of the user who carries the housing on the back; and a front-surface side, which is distal from the back side of the user who carries the housing on the back. The power-tool battery may be mounted on the battery-holding part by being slid in the direction from the front-surface side to the rear-surface side of the housing. In addition or in the alternative, an air-suction port, which is configured to communicate outside air, including dust or other particles contained therein, to the dust-collecting chamber, may be disposed or defined in an upper part of the housing. A controller, which controls the motor, may be disposed in the interior of the housing at the same height position as that of the motor.

In addition or in the alternative, a back-carried apparatus or dust collector may comprise: at least one battery or at least one battery pack; a (the) motor that is driven by electric current (power) supplied from the at least one battery or at least one battery pack; a belt (or harness) for carrying the at least one battery or at least one battery pack and the motor on the user's back; and a light that is illuminated by current (electric power) supplied from the at least one battery or the at least one battery pack. The light optionally may be provided on an operation unit (manual selector unit) that is connected to the housing via a (the) flexible cord. A hook or clip may be provided on the operation unit to hook or clasp the operation unit on the belt or harness, thereby enabling hands-free direction of the light, e.g., in a forward downward diagonal direction of the user.

In addition or in the alternative, a dust collector or back-carried apparatus may comprise: a dust-collector main body (canister); and a hose part (wand and optionally a flexible connection hose). The hose part may comprise a hand-graspable handle-pipe part (hollow wand handle). A hook or clip may be provided on a circumferential surface of the handle-pipe part. In such a dust collector or back-carried apparatus, the hose part can be kept hooked or clipped onto another structure, e.g., a belt worn by the user, and thereby fixed by the hook. Consequently, the hose part can be disposed in a fixed state in situations such as when the user does not want to carry the hose part by hand, when the hose part is stored when not in use, etc., thereby making the device more convenient for the user to use.

In addition or in the alternative, the hook or clip may be formed or shaped such that it is capable of hooking onto the other structure (e.g., belt) so that the suction-port side of the hose part is caused to face downward. In such a dust collector or back-carried apparatus, the suction-port side, which tends to become dirty during use, can be kept disposed downward facing, which is advantageous from the standpoint of hygiene.

In addition or in the alternative, the handle-pipe part may be formed or shaped so as to include a curved pipe at least in an intermediate portion thereof. In such an embodiment, the hook (clip) may be provided on an outer-circumference side of the curved portion and proximal to the suction-port side of the curve. In such an embodiment, the curvature of the handle-pipe part makes it easier for the user to grip/hold, as well as manipulate/direct, the handle-pipe part. Furthermore, when the hook (clip) is hooked onto the user's hip belt, the hook can be kept disposed spaced apart from the body (torso) such that the hook does not interfere with a connection hose (e.g., a flexible hose fluidly connecting the handle-pipe part to the dust-collector main body) while the suction-port side is oriented downward facing.

In addition or in the alternative, a dust collector or back-carried apparatus may comprise: a dust-collector main body (canister); and a hose part (wand and optionally a flexible connection hose). The hose part may comprise a hand-graspable handle-pipe part (hollow wand handle), as was described above. In addition, one or more expanded parts, which expand(s) an outer diameter of a circumferential surface of the handle-pipe part, may be provided on the circumferential surface. In such an embodiment, the fingers can be staid by the expanded part(s) when the user grasps the handle pipe and thus, such a design makes the handle-pipe part easier to grasp for the user.

In addition or in the alternative, the handle-pipe part may be formed or shaped so as to include a curved pipe at least in an intermediate portion thereof, and the expanded part(s) may be provided on the suction-port side of the curved portion. In such an embodiment, the palm, the finger(s), etc. of the hand are better staid when the user grasps the handle pipe (wand handle) and changes (redirects) the orientation on the suction-port side of the handle-pipe part, thereby improving ease of operation during cleaning.

In addition or in the alternative, two expanded parts may be formed by expanding the outer diameter of a curved outer-circumference-side portion and by expanding the outer diameter of a curved inner-circumference-side portion. In such an embodiment, the portions at which the outer diameter of the expanded part are expanded are designed to respectively make contact with the hand at the position of the palm and the position of the index finger, which enhances the sense of touch when grasped by the hand.

In addition or in the alternative, a dust collector or back-carried apparatus may comprise: a dust-collector main body (canister); and a hose part (wand and optionally a flexible connection hose). The hose part may comprise a hand-graspable handle-pipe part (hollow wand handle), as was described above. One or more flat parts, which is (are) designed to (respectively) contact one or more finger pads (fingertips) when the handle-pipe part is grasped, may be provided on one or more circumferential surfaces of the handle-pipe part. In such an embodiment, the user can hold the handle pipe by contacting the flat part(s) with the pad(s) of the finger(s), and the ease-of-grip can be ensured in a manner such that a variety of user gripping methods are also supported.

In addition or in the alternative, the handle-pipe part may be formed or shaped so as to include a curved pipe at least in an intermediate portion thereof, and two of the flat parts may be respectively provided on two opposite circumferential surfaces of the handle-pipe part orthogonal to a curvature radial direction. In such an embodiment, the fingers are better staid when the user grasps the handle pipe by positioning the palm on the outer circumferential side of the curvature.

DETAILED DESCRIPTION OF EMBODIMENTS

Figure 1:
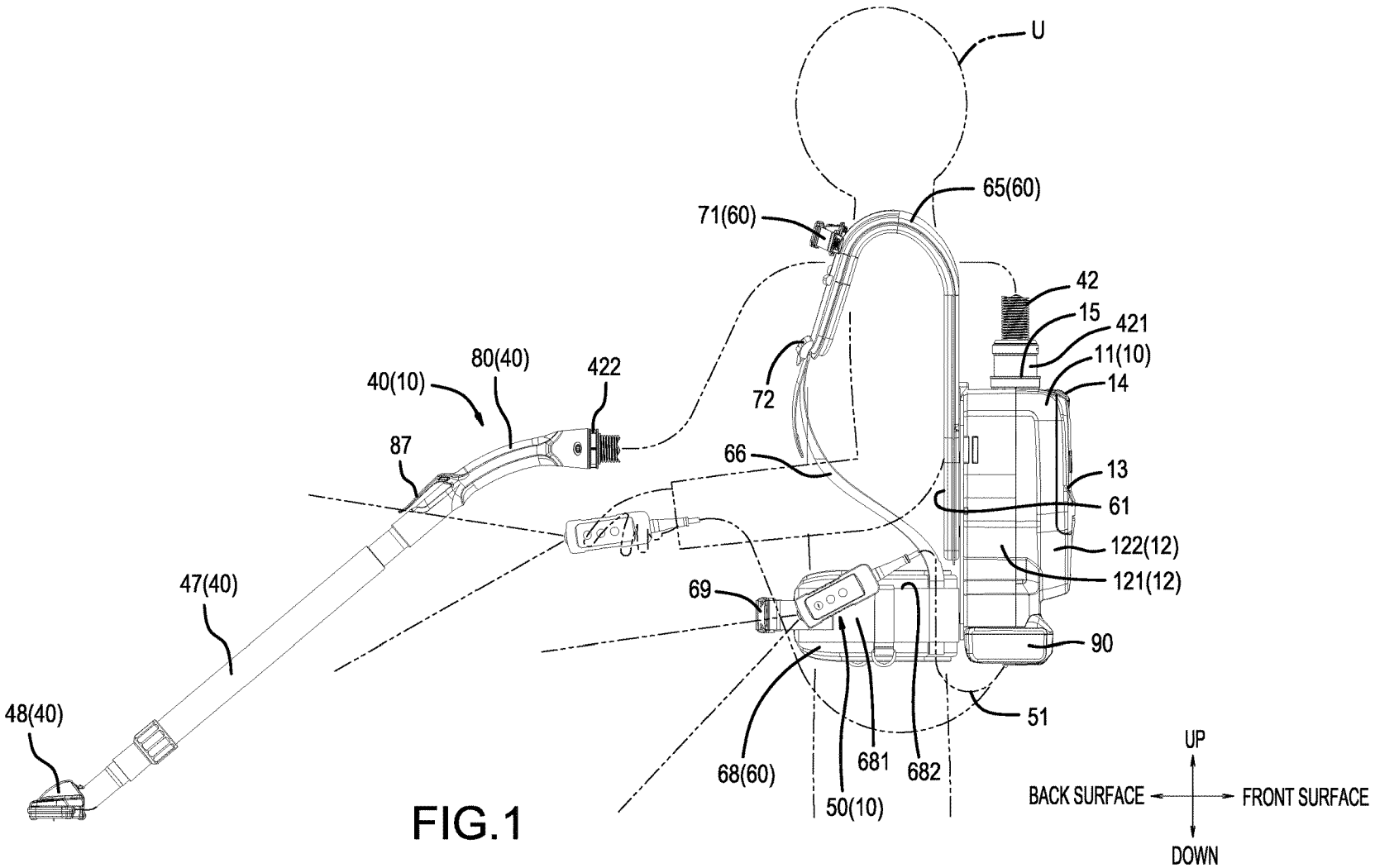
FIG. 1 is a side view that shows a dust collector (vacuum cleaner) according to one representative, non-limiting example of the present teachings, which is shown in side view while being carried on a user's back.

Embodiments for implementing a dust collector or vacuum cleaner according to the present teachings are explained below with reference to the drawings, wherein the explanation of the representative dust collector 10 below is based on the directions denoted in the drawings.

Referring first to FIG. 1, the dust collector 10 may preferably comprise one or more of, e.g., a dust-collector main body (or "canister") 11, a coupling-hose part (or "wand", e.g., a telescoping wand or extendable wand) 40, an operation unit (or "manual selector device") 50, and belt equipment (or a "harness") 60. In some of the subsequent figures, the coupling-hose part 40, the operation unit 50, etc. may not be shown to improve the clarity of the illustration. Reference letter U denotes a user who carries the dust-collector main body 11 on his or her back. The dust-collector main body 11 serves to generate a suction draft (partial vacuum) that is used to collect (sweep up or suction up) dust and other particles. The dust-collector main body 11 preferably comprises, e.g., a housing 12, a drive part 21, a dust-collection chamber 30, and one or more battery-mounting parts (battery pack mounts) 35. The housing 12 is formed by joining a rear-side housing 121 and a front-side housing 122 to form an internal hollow space. The drive part 21 is installed in the internal hollow space, substantially in a lower half of the housing 12. The portion of the internal hollow space located at least substantially in the upper half of the housing 12 is configured as the dust-collection chamber 30. In addition, the dust-collector main body 11 has a rear-surface side, which is proximate to the back side of the user U, when the dust-collector main body 11 is carried on the user's back, and a front-surface side, which is farther from the back side of the user U, when the dust-collector main body 11 is carried on the user's back.

Figure 10:
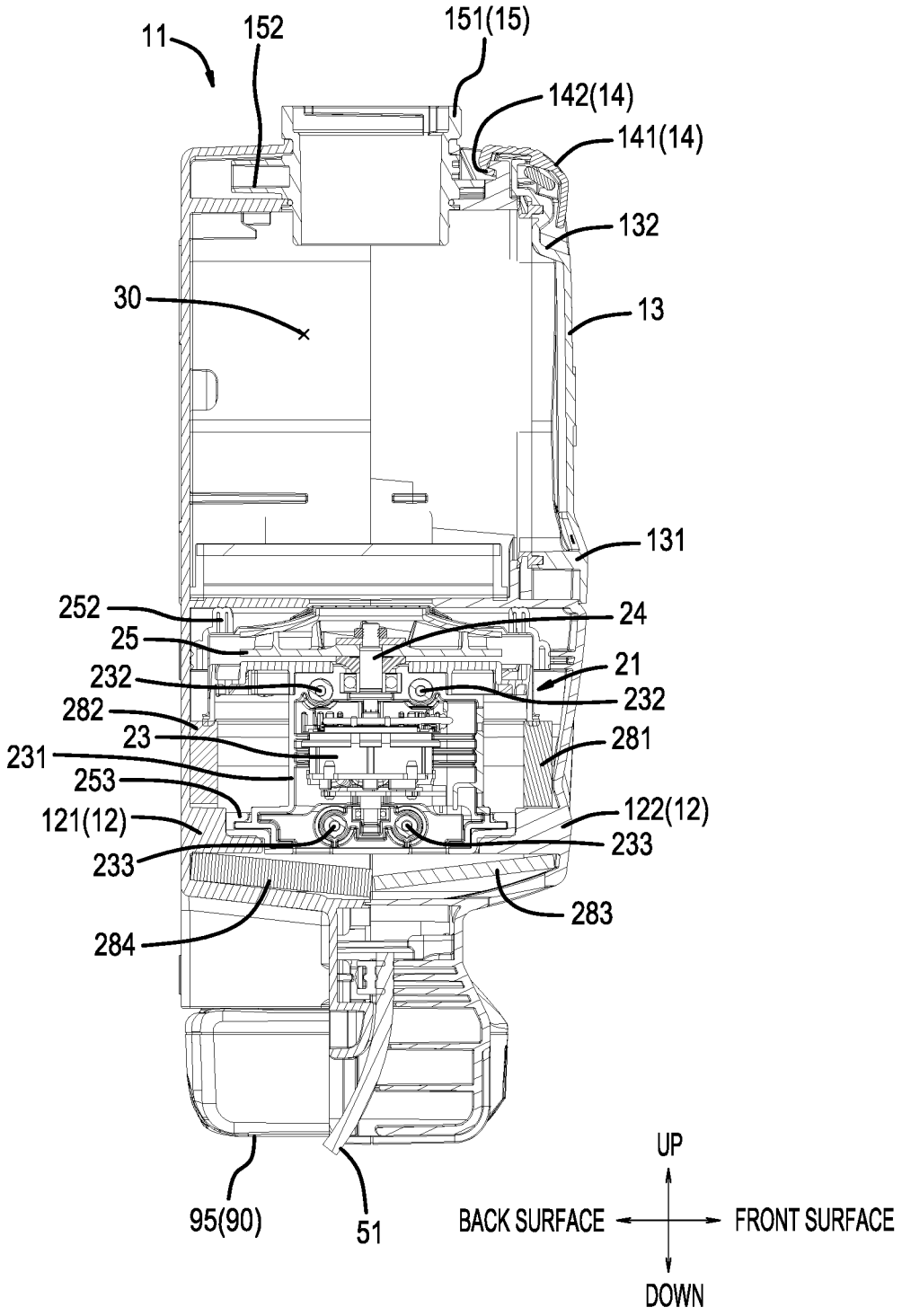
FIG. 10 is a cross-sectional view, taken along line (X)-(X) in FIG. 7, of the dust-collector main body.
Figure 11:
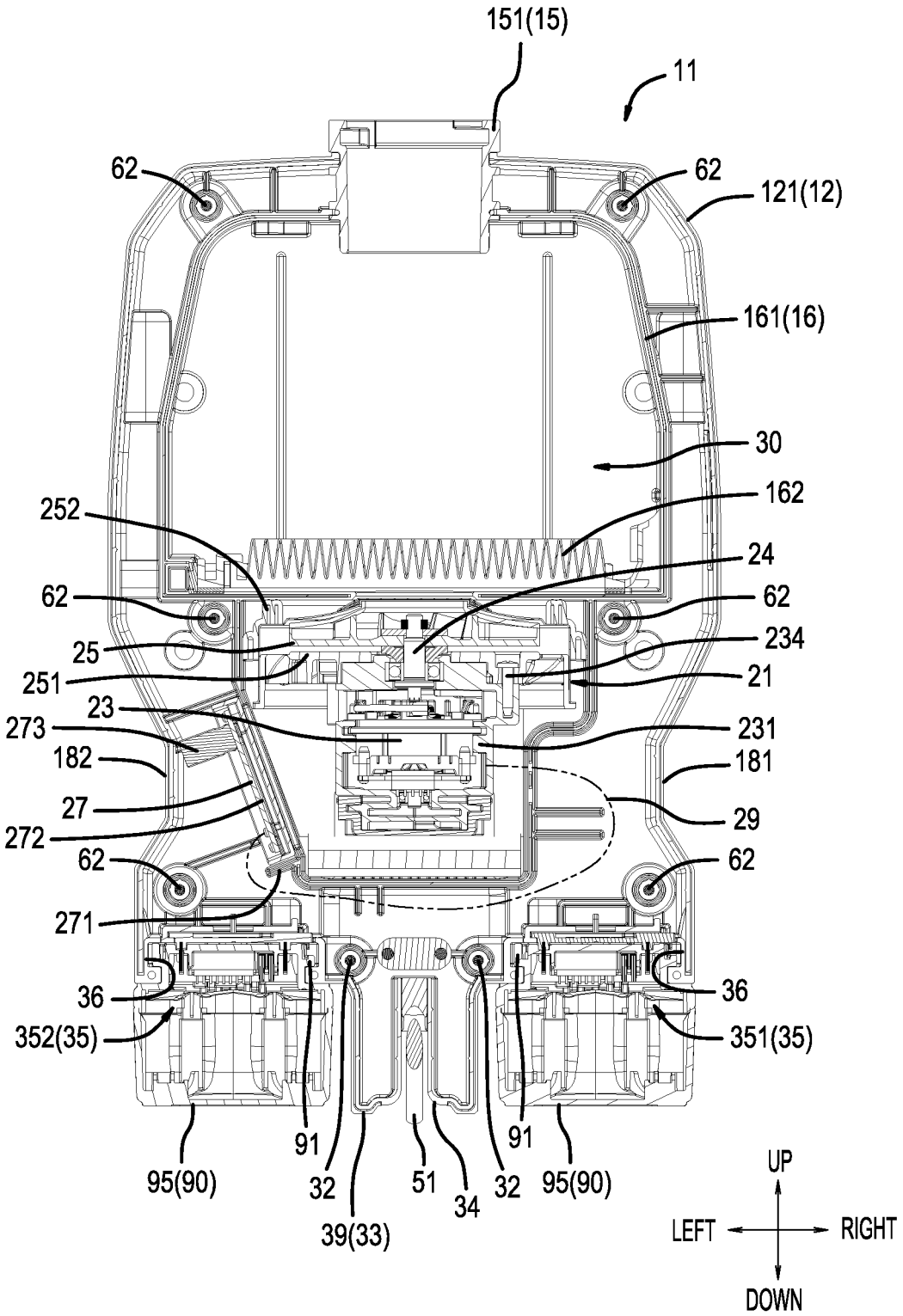
FIG. 11 is a cross-sectional view taken along line (XI)-(XI) in FIG. 8, of the dust-collector main body.

A not shown dust-collection bag can be disposed in the hollow dust-collection chamber 30 or the dust-collection chamber 30 can be configured to be "bag-less", e.g., by using centrifugal force to separate dust and particles from the air flowing into a cylindrical dust-collection chamber. That is, the dust-collection chamber 30 is configured as a space wherein dust is collected by the suction draft (partial vacuum) generated by the drive part 21, as shown in FIGS. 10 and 11. It is noted that the dust-collection chamber 30 serves as one representative, non-limiting example of a dust-collection part according to the present teachings. An air-suction port 15 is disposed in an upper end of the housing 12 located on the upper part of the dust-collection chamber 30. The air-suction port 15 is formed in substantially a circular shape in top view and provides fluid communication to the dust-collection chamber 30 in the interior. The air-suction port 15 is provided with a coupling flange 151 that is capable of coupling to the coupling-hose part 40, which will be explained below. The air-suction port 15 is an opening of (in) the housing 12 that makes it possible to suck in outside air, including dust or particles contained therein, toward the dust-collection chamber 30. In addition, exhaust slits 19 are provided in a lower part of the housing 12. The exhaust slits 19 comprise two types of slits, namely: first exhaust slits 191, which are directed toward a front surface of the dust-collector main body 11, and second exhaust slits 192, which are directed toward the space between two power-tool batteries (battery packs) 90 that are mounted on the lower part of the housing 12. The exhaust slits 19 serve as one representative, non-limiting example of an air-exhaust port according to the present teachings and are configured such that an exhaust draft can be blown out downwardly. That is, when the dust collector 10 is worn on the user's back, the exhaust slits 19 are designed to direct the exhaust draft downward, in particular away from the user's face.

The drive part 21 may comprise, e.g., a brushless motor 23, a suction fan 25, and a controller 27. The brushless motor 23 is supported by the housing 12 at a center position of the substantially lower side half of the housing 12. The brushless motor 23 comprises a DC brushless motor, which rotationally drives a rotary-drive shaft 24. The rotary-drive shaft 24 extends in the up-down direction and is located in a central position in the left-right direction. The suction fan 25 is attached to the rotary-drive shaft 24. The suction fan 25 is rotatably driven by the rotary-drive shaft 24 and thereby rotates to generate the suction draft (partial vacuum). The suction fan 25 is preferably a centrifugal fan that sucks in air from the dust-collection chamber 30 at its upper side in an axial direction of the rotary-drive shaft 24 and exhausts air toward an outer-circumference side in the radial direction of the rotary-drive shaft 24. The controller 27 controls (e.g., turns ON and OFF) the current (electric power) supplied to brushless motor 23 from the two power-tool batteries 90 mounted on the housing 12. As shown in FIG. 11, the controller 27 is disposed on the left side of the brushless motor 23 and is supported by the housing 12 such that it is tilted to the left side in its extension toward the upper side.

The suction draft generated by the suction fan 25 creates negative pressure (a partial vacuum) in the above-described dust-collection chamber 30. The dust-collection chamber 30, the pressure of which has become negative (i.e. below atmospheric pressure), sucks in outside air through the coupling-hose part 40 coupled to the air-suction port 15. Thus, by suctioning outside air, the dust-collector main body 11 also sucks in waste, such as dust and other particles, through the coupling-hose part 40. Furthermore, the suction draft generated by the suction fan 25 passes around (contacts and cools) the brushless motor 23 and is exhausted to the exterior of the housing 12 via the above-described exhaust slits 19 (i.e. the first exhaust slits 191 and the second exhaust slits 192). Furthermore, an outer-wall shape of the housing 12 is designed such that it closely conforms to the upper body of a person in front view. That is, substantially the upper side half of the housing 12 has an approximately rectangular parallelepiped shape. In contrast, a slightly indented recessed part 17 is provided on the front surface of the substantially lower side half of the housing 12. In addition, a right recessed part 181 and a left recessed part 182 are respectively provided on the right and left sides of the substantially lower side half of the housing 12.

Referring again to FIG. 10, an open/close cover 13, which makes it possible to open and close the dust-collection chamber 30, is pivotally attached to the front-surface portion of the substantially upper-side half of the housing 12. A lower-side edge 131 of the open/close cover 13 is hinged by a (not shown) rotary shaft (pin), which is supported by the housing 12. A latching structure 14 is provided on an upper-side edge 132 of the open/close cover 13. The latching structure 14 comprises a hook 141, which is supported such that it can swing or pivot with respect to the open/close cover 13, and a female-hook part 142, into which the hook 141 hooks (engages). The female-hook part 142 is provided proximate to the upper end of the housing 12. When the hook 141 is hooked onto (in) the female-hook part 142, the open/close cover 13 of the dust-collection chamber 30 is latched in a closed state.

As shown in FIGS. 10 and 11, the coupling flange 151 includes a protruding part (hollow projection) 152, which protrudes from the rear-surface side of the coupling flange 151. The protruding part 152 ensures proper assembly (orientation) of the coupling flange 151 when the rear-side housing 121 is being mounted onto (joined with) the front-side housing 122. The brushless motor 23 is housed in a motor case 231, which is partitioned in the left-right direction. Not shown mating surfaces, which convexly and concavely mate with one another, are respectively provided on left and right inner circumferential surfaces of the motor case 231. In addition, a not shown mating part, which concavely and convexly mates with its counterpart, is provided on an outer circumferential surface of a stator of the brushless motor 23. The mating part serves to determine (define) the up-down direction position and the circumference-direction position of the stator of the brushless motor 23 based on the concave/convex mating relationship of the mating part with respect to the motor case 231.

The motor case 231 is fixed by tightening two upper screw-fastening parts (screws) 232 and two lower screw-fastening parts (screws) 233. A screw 234 is screwed into the motor case 231 such that the screw 234 extends in the up-down direction. The screw 234 fixes a fan guide 251. An annular first rubber member 252 is disposed between the fan guide 251 and the housing 12. The first rubber member 252 is preferably designed to attenuate the propagation of rotational vibration of the brushless motor 23 and the suction fan 25 from the fan guide 251 to the housing 12. In addition, an annular second rubber member 253 is disposed between the lower part of the motor case 231 and the housing 12. The second rubber member 253 is preferably designed to attenuate the propagation of rotational vibration of the brushless motor 23 and the suction fan 25 from the motor case 231 to the housing 12.

A first sound-insulating member 281 is disposed on the front-surface side of the motor case 231. In addition, a second sound-insulating member 282 is disposed on the rear-surface side of the motor case 231. The first sound-insulating member 281 and the second sound-insulating member 282 preferably each have both sound-absorbing properties and sound-blocking (sound-reflecting) properties. Specifically, the first sound-insulating member 281 and the second sound-insulating member 282 are formed by molding a foamed material having sound-absorbing properties. In addition, the first sound-insulating member 281 and the second sound-insulating member 282 also preferably block (inwardly reflect) sound such that sound generated by the brushless motor 23 or the suction fan 25 tends not to leak to the exterior of the housing 12. A first filter 283 is disposed on the front-surface side and downward of the motor case 231. In addition, a second filter 284 is disposed on the rear-surface side and downward of the motor case 231. The first filter 283 and the second filter 284 are designed to filter the exhaust draft, thereby removing any dust or particles that leak through the dust collection bag so that the exhaust draft is preferably particle-free or at least substantially particle-free. Furthermore, the first filter 283 and the second filter 284 may also act to block (absorb and/or reflect) sound from exiting the housing 12 by impeding the propagation of sound generated by the brushless motor 23 or the suction fan 25 to the exterior.

The rear-side housing 121 and the front-side housing 122 are integrally screw-tightened by a not shown screw member that is disposed such that it extends in the front-rear direction. As shown in FIG. 11, a filter 162 is disposed in the downward (bottom) portion of the dust-collection chamber 30. In addition, a gasket 161 is attached to a circumferential edge of an opening 16 that is opened and closed by the open/close cover 13. The gasket 161 forms a seal with the open/close cover 13 when the open/close cover 13 is closed. That is, the gasket 161 increases the airtightness of the interior of the dust-collection chamber 30.

As was noted above, current (electric power) is supplied to the brushless motor 23 via the controller 27. The controller 27 comprises a circuit board 272, which is housed in a controller case 271. The circuit board 272 is provided with a microcontroller (microprocessor, memory and associated circuitry), a plurality of (e.g., six) power FETs (field-effect transistors), a capacitor 273, etc. The circuit board 272 is integrally molded with (bonded to) the controller case 271 using a resin filler (e.g., a resin material that fills the spaces between the circuit board 272 and the controller case 271) with the circuit board 272 housed inside the controller case 271.

The controller 27 controls the rotation of the brushless motor 23. The controller 27 (or the controller case 271) is disposed inside the housing 12 at the same height position as the brushless motor 23 in the up-down direction. The controller case 271 is disposed along the air passageway of the suction draft generated by the suction fan 25. Consequently, this draft contacts and thereby cools the controller 27 during operation of the dust collector 10. The brushless motor 23 is electrically connected to the controller 27 via a power-supply pathway 29. The power-supply pathway 29 comprises lead wires, etc. It is noted that, although the controller 27 is disposed in the left-side area in the illustrated example, it also would be advantageous to dispose it in the right-side area in order to shorten the power-supply pathway 29. In addition, an external (flexible) cord 51 is firmly affixed to a midway-intervening part 33 by two screws 32 such that the external cord 51 is not easily disconnected therefrom, even if the cord 51 is subjected to a strong tensile load (pulling force).

The midway-intervening part 33 is provided at the center of the lower part of the housing 12 such that the midway-intervening part 33 partitions the lower part of the housing 12 into left and right spaces. The battery-mounting parts (battery pack mounts) 35 are provided such that they are aligned in parallel to the left and right of the midway-intervening part 33. That is, a right-battery-mounting part 351 is provided to the right of the midway-intervening part 33 and a left-battery-mounting part 352 is provided to the left of the midway-intervening part 33. The right-battery-mounting part 351 and the left-battery-mounting part 352 are provided such that they have left-right symmetry with respect to the midway-intervening part 33. The right-battery-mounting part 351 and the left-battery-mounting part 352 each comprise the identical battery-mounting part 35, i.e. the structural elements of parts 351 and 352 are preferably identical. The battery-mounting parts 35 (351, 352) are configured such that the power-tool batteries (battery packs) 90 can be mounted thereto and dismounted therefrom. The power-tool batteries 90 mounted on the battery-mounting parts 35 may be widely used batteries (battery packs) that serve as batteries for power tools such as driver-drills, impact drivers, circular saws, grinders, etc. Furthermore, the battery-mounting parts 35 serve as one representative, non-limiting example of a battery-holding part according to the present teachings.

Figure 13:
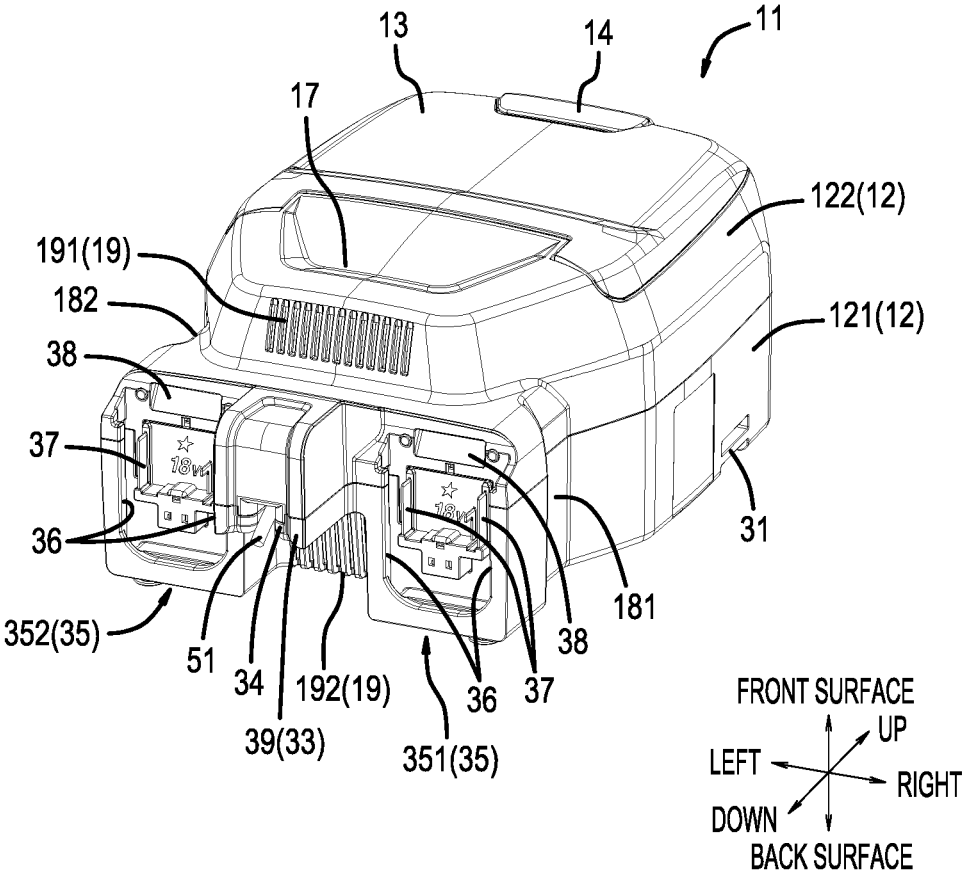
FIG. 13 is a bottom oblique view of the dust-collector main body, wherein power-tool batteries (battery packs) have been removed.

Because the power-tool batteries 90 are slide-mountable batteries (battery packs), the battery-mounting parts (battery pack mounts) 35 are likewise configured as slide-mountable mounting parts. As shown in FIG. 13, each battery-mounting part 35 is preferably provided with sliding-guide parts (guide rails) 36, slide-connection terminals (power and communication terminals) 37, and a latching female-hook part 38. The shape of the sliding-guide parts 36 corresponds to (is complementary to) the shape of the sliding-guide parts (guide rails) 91 of each power-tool battery 90 so that a sliding engagement results. The slide-connection terminals 37 correspond to (are complementary to) slide-connection terminals (not shown) provided on the power-tool battery 90. The latching female-hook part 38 is designed to latch and fixedly engage a corresponding male-hook part 93 of the power-tool battery 90. To mount the power-tool batteries 90, each power-tool battery 90 is slid onto the corresponding battery-mounting part 35 in the direction from the front surface to the back surface with the top surface 97 of each of the batteries 90 facing the bottom of the housing 12. In addition, to remove the power-tool batteries 90, each power-tool battery 90 is slid in the direction from the back surface to the front surface after the latching of the male-hook part 93 has been released (e.g., by depressing a button connected thereto). When mounted in this manner, an imaginary line 99 (FIG. 8) perpendicular to the lower surface 95 of one of the batteries 90 extends in a first direction from the top surface 97 of the battery 90 into the housing 12 and extends in a second direction opposite the first direction from the lower surface 95 of the battery 90 without intersecting any portion of the dust collector 10.

Figure 12:
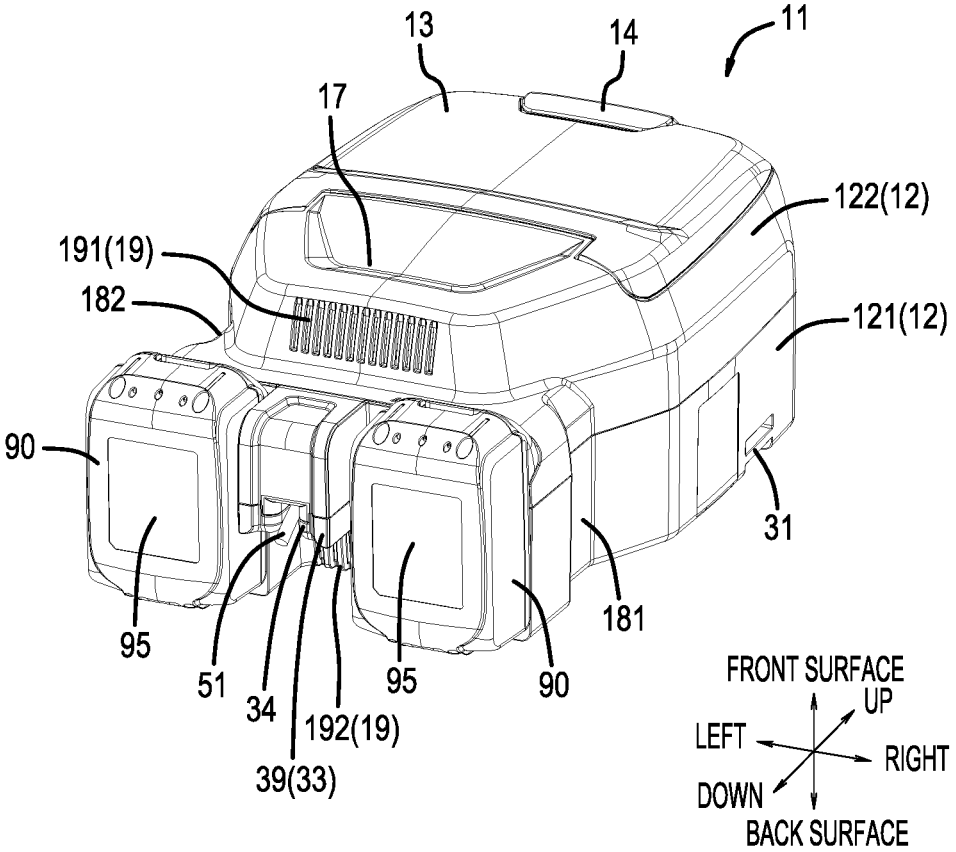
FIG. 12 is a bottom oblique view of the dust-collector main body.

Referring to FIGS. 11 and 12, lower surfaces 95 of the power-tool batteries 90, which are respectively mounted on the battery-mounting parts 35 (351, 352), are configured such that they are at least substantially flush with a lower surface 39 of the midway-intervening part 33. If these lower surfaces 39, 95 are configured to extend in a substantially planar manner, the dust-collector main body 11 can be set down in an upright orientation such that it is supported by these three lower surfaces. It is noted that the midway-intervening part 33 is provided in the center-lower part of the housing 12 such that the midway-intervening part 33 is inserted (interposed) between the right-battery-mounting part 351 and the left-battery-mounting part 352. The midway-intervening part 33 has a substantially rectangular outer shape and is continuously connected to the housing 12. A recessed groove 34 is provided on a lower part of the midway-intervening part 33. The external cord 51 of the operation unit 50, which will be further explained below, is led out from (through) the recessed groove 34.

Next, the coupling-hose part 40, which serves as one representative, non-limiting example of a hose part according to the present teachings, will be explained with reference to FIGS. 14-16. The coupling-hose part 40 may comprise, e.g., a connection hose (flexible hose) 42 and the coupling nozzle (wand) 43. It is noted that the coupling nozzle 43 may comprise, e.g., the handle pipe (hollow wand handle) 80, a telescoping pipe (extension wand or extension tube) 47, and an intake nozzle (suction nozzle) 48 or other vacuuming attachment, such as a brush or crevice tool. The connection hose 42 is preferably an accordion-type hose that is widely used as a vacuum cleaner hose. The connection hose 42 is formed of a soft (flexible) resin that is easily twistable and bendable.

Figure 16:
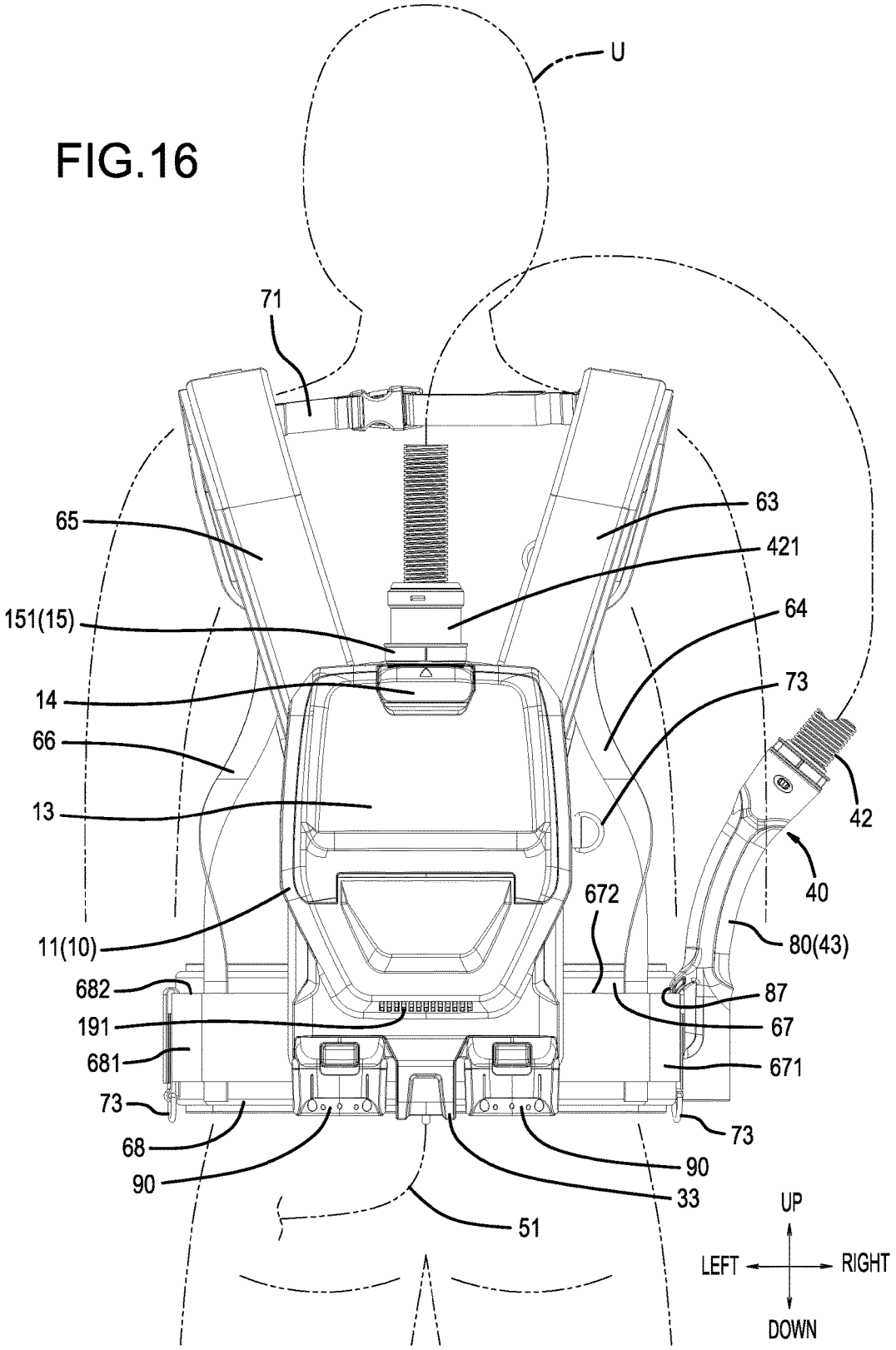
FIG. 16 is a front view of the dust collector while being carried on the user's back, wherein the handle pipe has been hooked onto a hip belt.
Figure 17:
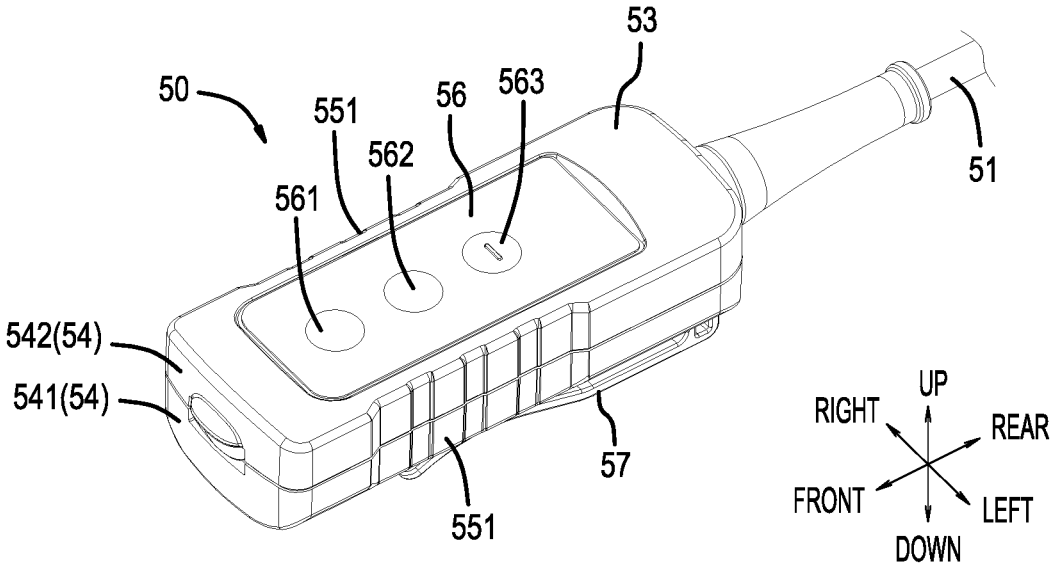
FIG. 17 is a top oblique view of an operation unit (manual selector device).

As shown in FIGS. 1 and 16, a base-end connection part 421 is provided on a base end of the connection hose 42. The base-end connection part 421 is configured to be connected to the air-suction port 15 of the dust-collector main body 11. In addition, as shown in FIG. 14, a tip-connection part 422 is provided on a tip of the connection hose 42. The tip-connection part 422 is configured to be connected to a hose-connection part 81 of the handle pipe 80, which will be explained next. It is noted that the handle pipe 80 serves as one representative, non-limiting example of a handle-pipe part (hollow wand handle) according to the present teachings. In addition, the telescoping pipe 47 may be a widely used telescoping pipe (extension wand), and the intake nozzle 48 likewise may be any widely used intake nozzle (vacuum attachment).

Figure 14:
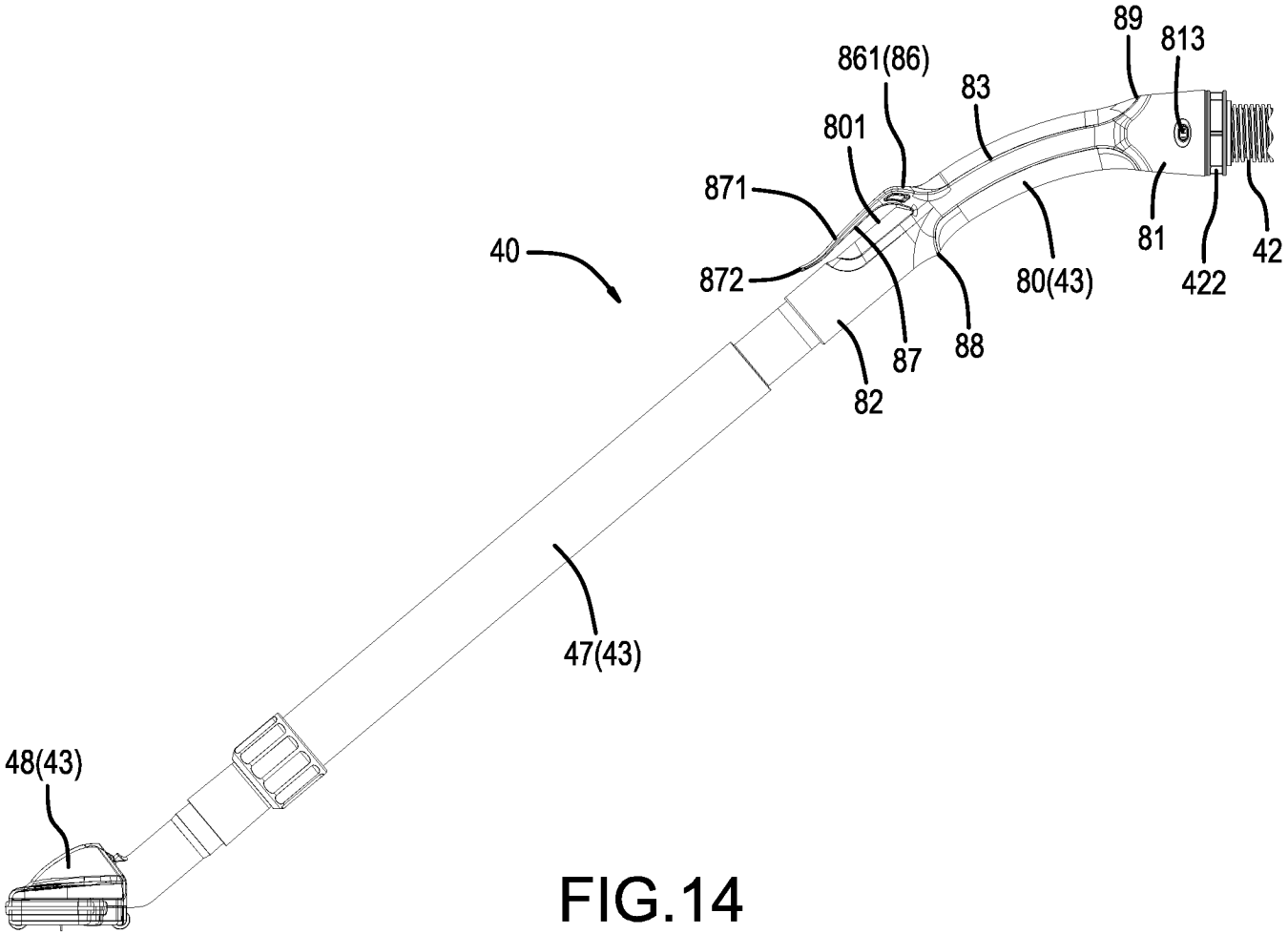
FIG. 14 is a left-side view of a coupling hose (wand).
Figure 15:
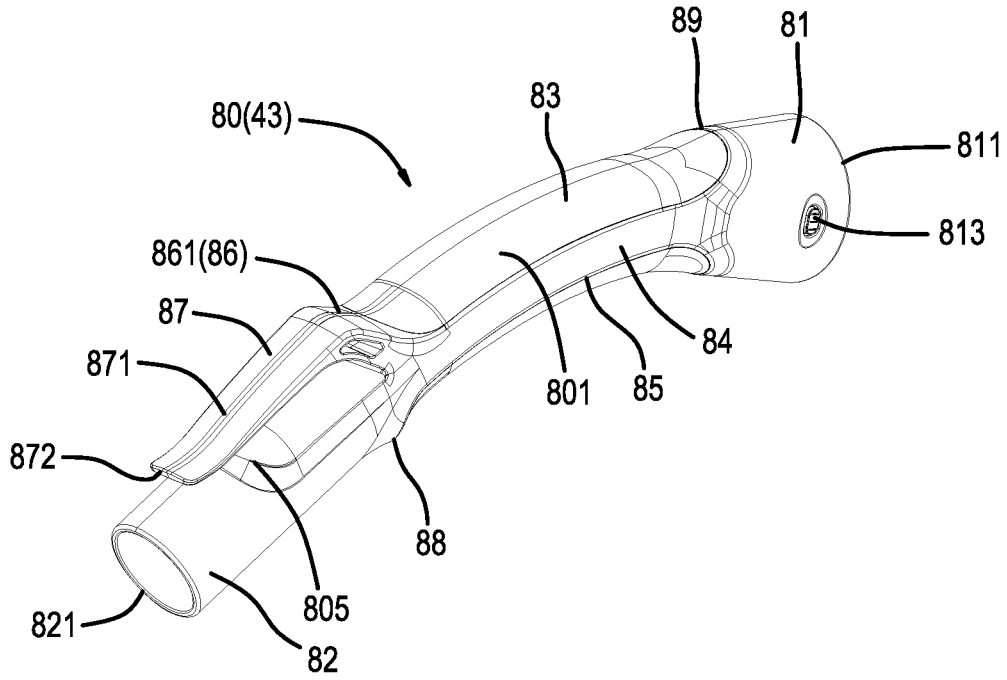
FIG. 15 is a front oblique view of a handle pipe (hollow wand handle).
Figure 29:
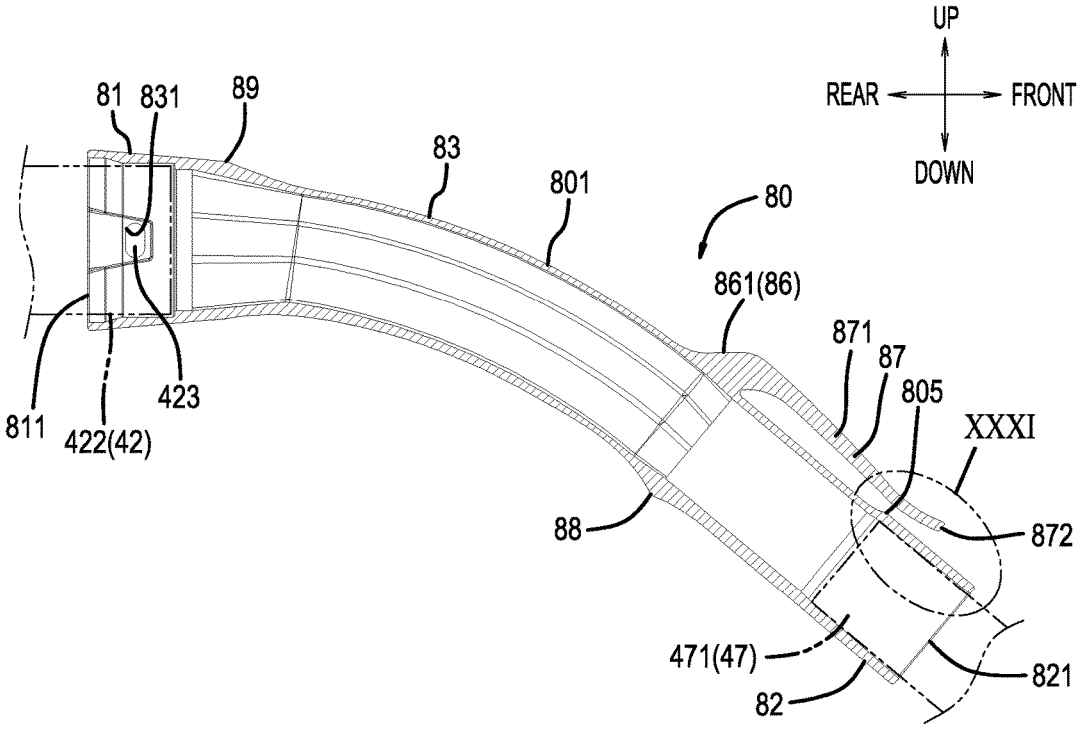
FIG. 29 is a cross-sectional view taken along line (XXIX)-(XXIX) in FIG. 23.

As shown in FIG. 14, the handle pipe 80 is interposed between the connection hose 42 and the coupling nozzle 43 and has an intermediate portion formed into a curved pipe shape. The handle pipe 80 is preferably made of a rigid plastic resin, although part or all of it could be made of metal. The handle pipe 80 has a gentle bend in its intermediate region between the base end and the tip. For example, the handle pipe 80 preferably comprises a (straight) hose-connection part 81 for detachably connecting to the connection hose 42 on its base-end side, a (straight) pipe-connecting part 82 for detachably connecting to the telescoping pipe (extension wand) 47 on its tip side, and a curved-grip part 83 at its intermediate region (i.e. between straight parts 81 and 82). The hose-connection part 81 is a base-end portion of the handle pipe 80, and the tip-connection part 422 of the connection hose 42 is capable of connecting to the hose-connection part 81. A base-side opening 811 is disposed (defined) in the base end of the hose-connection part 81, as shown in FIG. 29. The opening cross-sectional shape of the base-side opening 811 has an inner diameter that is slightly larger than the outer diameter of the tip-connection part 422 such that the tip-connection part 422 of the connection hose 42 can be inserted into the base-side opening 811.

Figure 22:
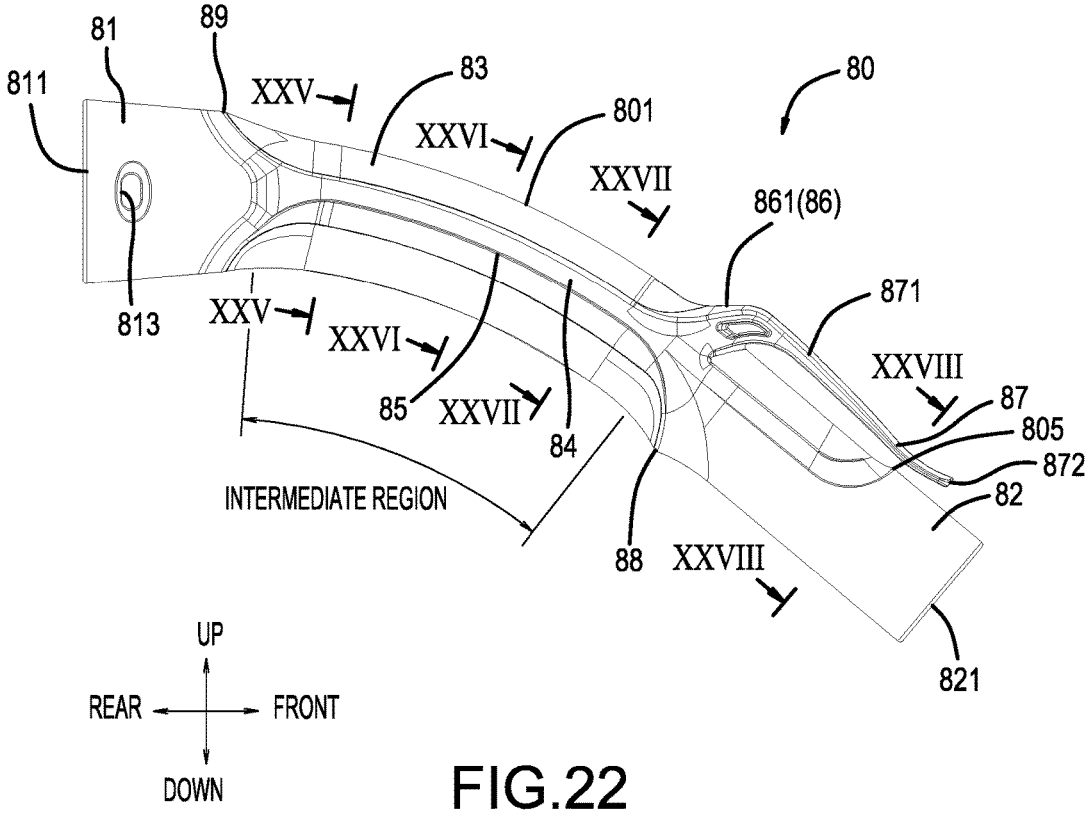
FIG. 22 is a side view of the handle pipe.
Figure 23:
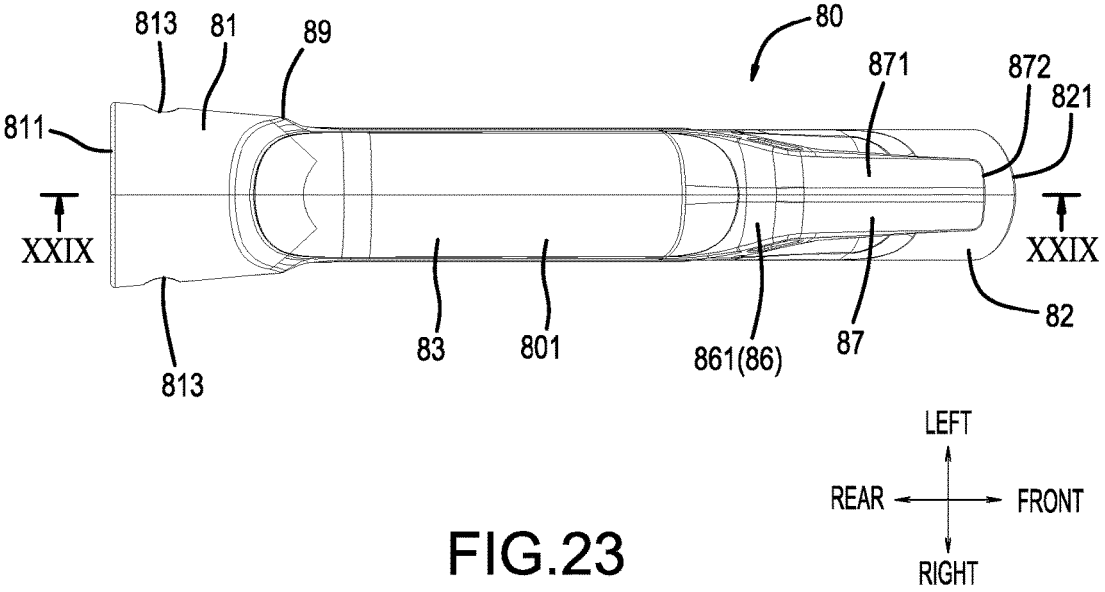
FIG. 23 is a top view of the handle pipe.

As shown in FIGS. 22-23, mating holes 813 are provided proximate to the base-side opening 811. Mating-convex parts 423 are provided on an outer circumference of the tip-connection part 422 and are designed to respectively mate with the mating holes 813. When the mating-convex parts 423 mate with the mating holes 813 as shown in FIG. 29, the insertion of the tip-connection part 422 into the base-side opening 811 is secured. The mating holes 813 and the mating-convex parts 423 form pairs on both the left and right sides, and the mating of the mating-convex parts 423 with the mating holes 813 can be released by elastically deforming the mating-convex parts 423 by inwardly pressing (squeezing together) the mating-convex parts 423. Furthermore, because the tip-connection part 422 of the connection hose 42 is molded from a relatively soft (flexible or elastically deformable) material, the tip-connection part 422 elastically deforms much more easily than the handle pipe 80, the telescoping pipe 47, etc., which are preferably made from relatively rigid materials. Furthermore, when the mating of the mating-convex parts 423 with the mating holes 813 is released, the connection hose 42 can be removed from the base-side opening 811.

Figure 31:
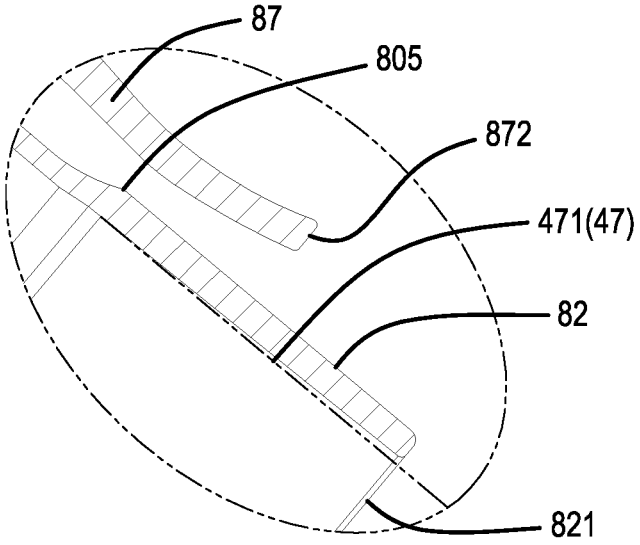
FIG. 31 is an enlarged cross-sectional view of the dashed-circle portion (XXXI) in FIG. 29.

The pipe-connecting part 82 is a tip portion of the handle pipe 80, and the telescoping pipe 47 or a base-end connection part 471 of the intake nozzle 48 can be connected to this tip portion. A distal-side opening 821 is disposed (defined) at the tip of the pipe-connecting part 82, as shown in FIG. 29. The opening cross-sectional shape of the distal-side opening 821 has an inner diameter that is slightly larger than the outer diameter of the base-end connection part 471 such that the base-end connection part 471 of the telescoping pipe 47 can be inserted into the distal-side opening 821. As shown in FIG. 31, an inner circumferential diameter of the distal-side opening 821 is set (designed or shaped) such that it becomes smaller in the direction from the distal-side opening 821 to the curved-grip part 83. Consequently, as the base-end connection part 471 of the telescoping pipe 47 is being inserted through the distal-side opening 821, the frictional force between them gradually increases, and thereby the insertion of the base-end connection part 471 into the distal-side opening 821 is maintained. Furthermore, a tip part 872 of a hook (clip) 87, which will be explained below, is disposed on a radially outer side of the pipe-connecting part 82. The distal-side opening 821 constitutes the suction-port-side end part of the handle pipe 80.

Figure 24:
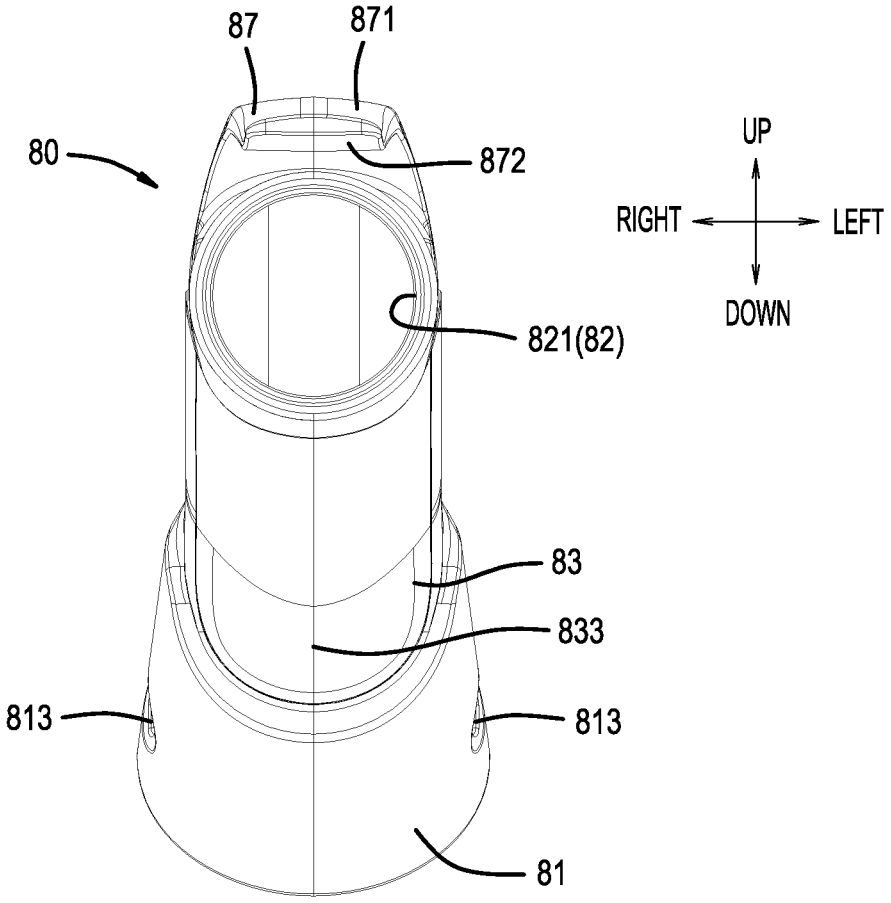
FIG. 24 is a front view of a suction-port side of the handle pipe.
Figure 25:
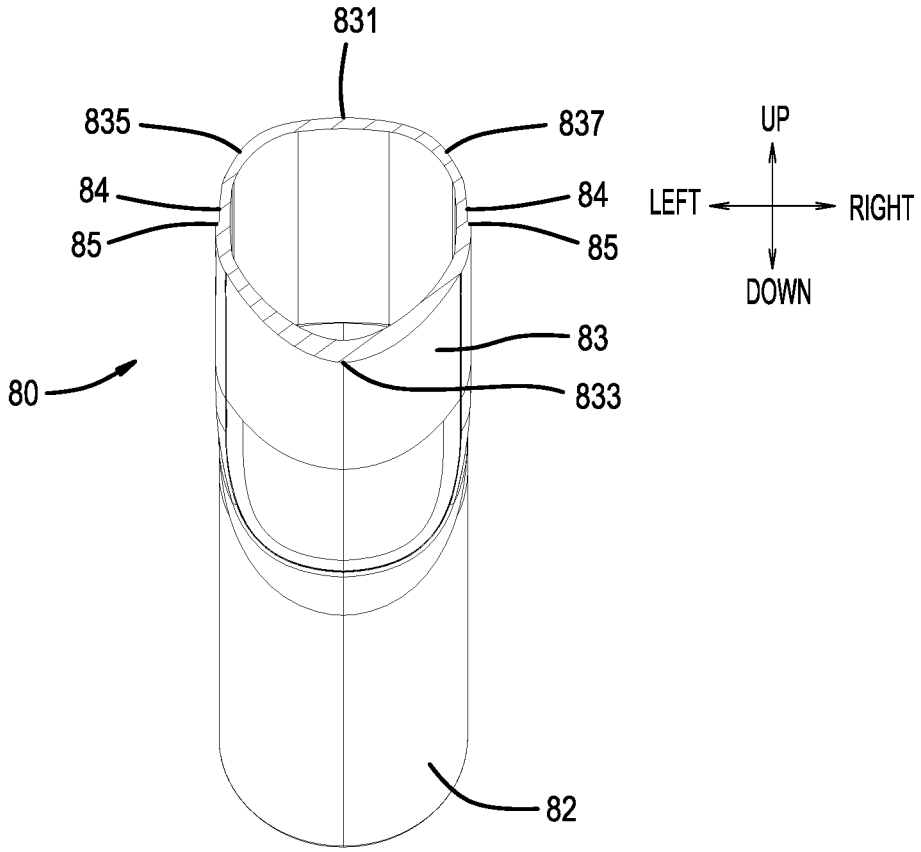
FIG. 25 is a cross-sectional view taken along line (XXV)-(XXV) in FIG. 22.
Figure 26:
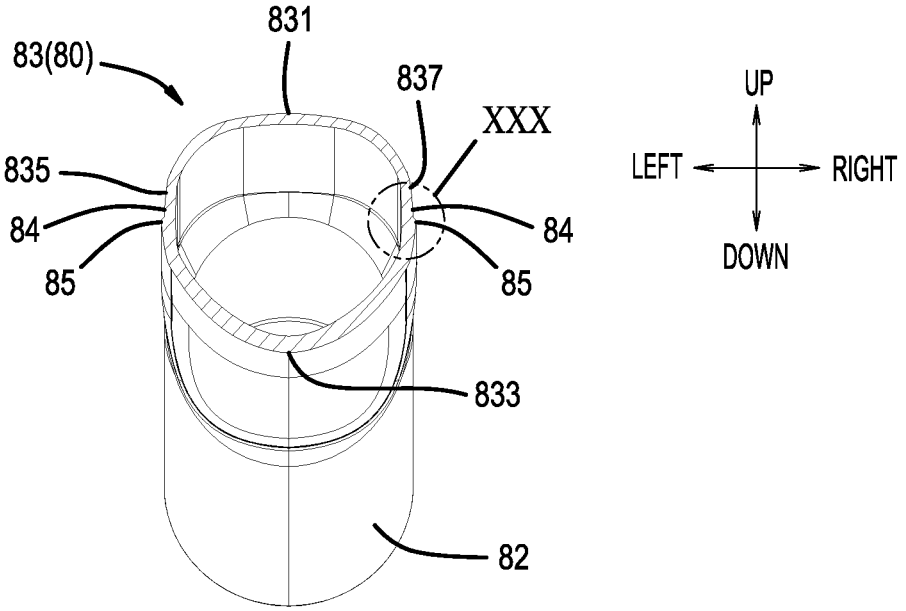
FIG. 26 is a cross-sectional view taken along line (XXVI)-(XXVI) in FIG. 22.
Figure 27:
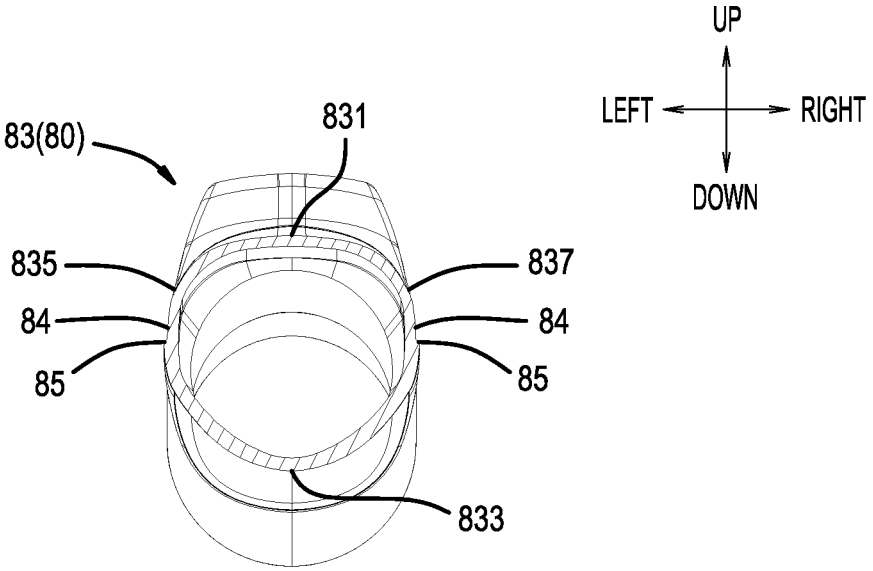
FIG. 27 is a cross-sectional view taken along line (XXVII)-(XXVII) in FIG. 22.
Figure 28:
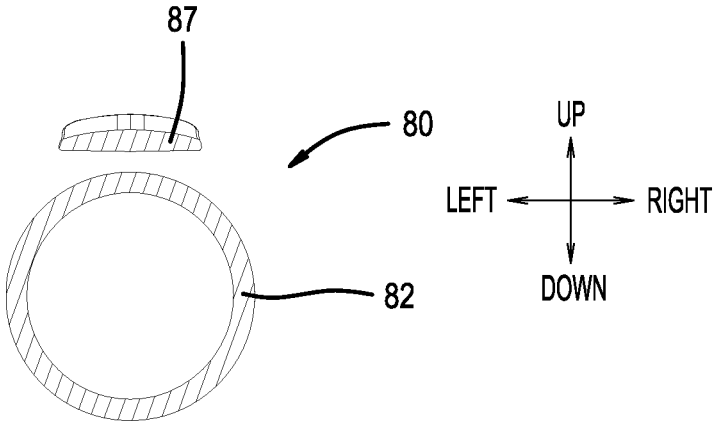
FIG. 28 is a cross-sectional view taken along line (XXVIII)-(XXVIII) in FIG. 22.

As shown in FIGS. 22, 23 and 29, the curved-grip part 83 is provided at the intermediate region between the hose-connection part 81 and the pipe-connecting part 82 and is formed integrally with the hose-connection part 81 and the pipe-connecting part 82. Unlike a straight-line shape into which the tip-connection part 422, the base-end connection part 471, and the like can be inserted, the curved-grip part 83 has a gently curved shape. The curved-grip part 83 functions as the principal grip (handle) portion that is grasped (held) by the user's hand during operation (vacuuming). For example, the user may typically grasp or hold the curved-grip part 83 and manipulate or move the curved-grip part 83 so as to change the direction/position of the intake nozzle 48 that vacuums dust from the floor, stair, furniture, etc. Consequently, the shape of the handle pipe 80, which includes the curved-grip part 83, is preferably designed to improve the ease-of-handling by the user U. That is, in contrast with the cross-sectional annular (circular) shape of the opening shape and the outer circumferential shape of the distal-side opening 821 as shown in FIG. 24 and FIG. 28, a modified cross-sectional ring shape (i.e. a non-circular shape) is selected for the outer circumferential shape of the curved-grip part 83 as shown in FIG. 25 to FIG. 27.

For example, the ring shape of the curved-grip part 83 may be formed by connecting a gently arcuate part 831 on the upper side and a sharply arcuate part 833 on the lower side via two coupling parts 835, 837 on the left and right sides, respectively. The gently arcuate part 831 on the upper side is formed by smoothening or flattening the arcuate (circular) shape to the extent that it becomes nearly flat. In contrast, the sharply arcuate part 833 on the lower side is formed by sharpening the arcuate (circular) shape such that a center portion of the sharply arcuate part 833 protrudes from the lower side. The coupling parts 835, 837 on the left and right sides, which form a pair of continuous connections between the gently arcuate part 831 and the sharply arcuate part 833, are each formed such that they have a slightly arcuate shape. Therefore, when the user U grasps the curved-grip part 83, the web (symbol H6 in FIG. 32), which is between the thumb and the index finger, and the palm of the hand are likely to contact the gently arcuate part 831 on the upper side. The gently arcuate part 831 on the upper side is designed as a surface that is gently curved such that the gently arcuate part 831 does not cause pain in the hand.

On the lower side of the handle pipe 80, the index finger and the middle finger easily span (extend across or around) the sharply arcuate part 833 when the user U grasps the curved-grip part 83. The sharply arcuate part 833 on the lower side is a curved surface that is curved sharply such that it provides a ridge that is easily gripped. As was noted above, the coupling parts 835, 837 on the left and right sides continuously connect the gently arcuate part 831 above and the sharply arcuate part 833 below. Furthermore, the upper side, on which the gently arcuate part 831 is disposed, constitutes a curved outer-circumference-side portion according to the present teachings, and the lower side, on which the sharply arcuate part 833 is disposed, constitutes a curved inner-circumference-side portion according to the present teachings. That is, the up-down direction of the curved-grip part 83 coincides with a curvature radial direction, and the left-right direction of the curved-grip part 83 coincides with a direction that is orthogonal to the curvature radial direction. In addition, the gently arcuate part 831, the sharply arcuate part 833, and the coupling parts 835, 837 on the left and right sides are continuously connected and thereby constitute the circumferential surface of the curved-grip part 83.

Figure 30:
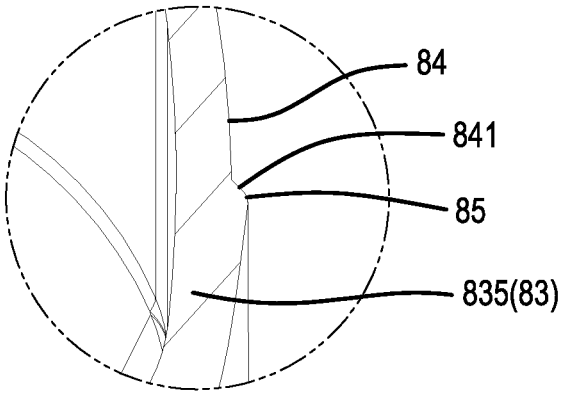
FIG. 30 is an enlarged cross-sectional view of the dashed-circle portion (XXX) in FIG. 26.
Figure 33:
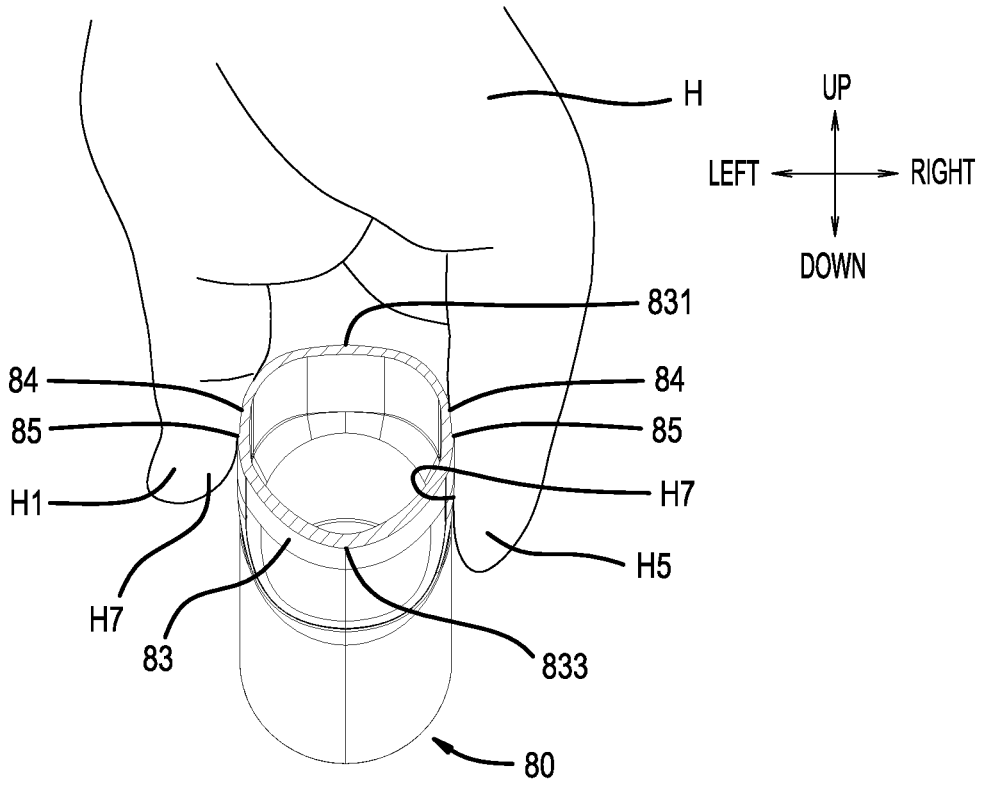
FIG. 33 is a cross-sectional view of another example of the handle pipe being grasped by a hand.

Flat parts 84 are provided on/in the coupling part 835, 837 on the left and right sides (both circumferential surfaces). As shown in FIG. 33, the flat parts 84 are formed as substantially flat surfaces so that the pads of fingers, i.e. the fingertip(s), can contact the flat parts 84 when the user U grasps the curved-grip part 83. The flat parts 84 are provided such that the left-side coupling part 835 and the right-side coupling part 837 form a pair. As shown in FIG. 22, the flat parts 84 are provided such that they extend from a base side to a distal side of the curved-grip part 83 over an area that coincides with the area wherein the curved-grip part 83 is disposed. Each flat part 84 has an up-down width of approximately 5 mm and extends such that it coincides with the curved shape of the curved-grip part 83. As shown in FIGS. 25-27 and 30, bulge parts 85, which bulge slightly toward the outer side (i.e. they bulge radially outward), are provided at lower ends of the flat parts 84. In the same manner as the flat parts 84 extend, the bulge parts 85 extend as lower-end edges of the flat parts 84 such that they coincide with the curved shape of the curved-grip part 83. As shown in FIG. 30, steps (ridges) 841 are disposed between the flat parts 84 and the bulge parts 85, thereby making it easier for the user U to grasp the flat parts 84. Thus, by making the flat parts 84 easier to grasp, the ease-of-orientation (manipulation) of the curved-grip part 83, the ease-of-grip of the curved-grip part 83, and the like, can be improved.

Figure 32:
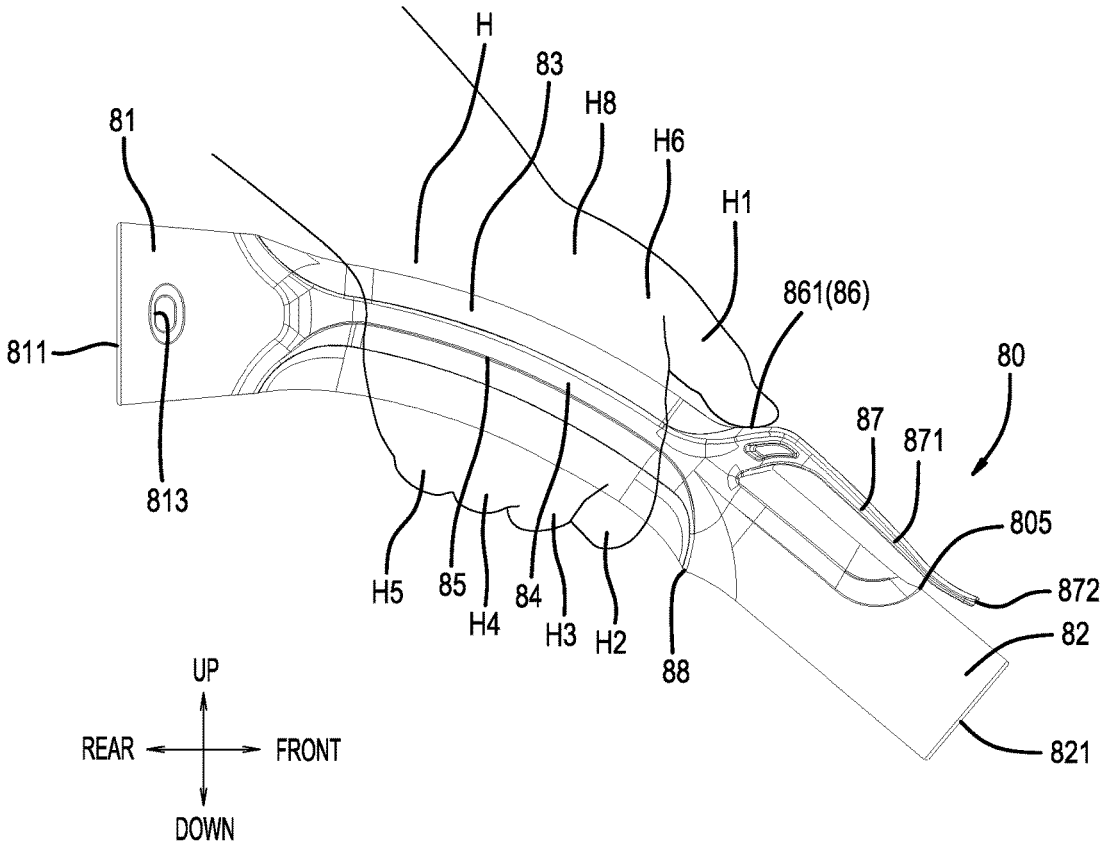
FIG. 32 is a side view that shows one example of the handle pipe being grasped by a hand.

As can be understood from the cross sections in FIGS. 25-27, the curved-grip part 83 is formed with substantially the same cross-sectional shape at every location at which it curves. That is, the curved-grip part 83 is curved such that its inner circumferential shape and outer circumferential shape are maintained in the axial direction thereof. As shown in FIGS. 22 and 29, a finger-placement part 86 and a protruding part 88, which serve as representative, non-limiting examples of expanded parts according to the present teachings, are provided at the lower end (front side) of the curved-grip part 83. The finger-placement part 86 and the protruding part 88 are formed such that the outer diameter of an outer circumferential surface of the finger-placement part 86 and the protruding part 88 becomes larger (is more expanded) than the outer circumferential surface 801 of the curved-grip part 83. That is, the finger-placement part 86 has an outer shape that protrudes farther toward the upper side than does the outer circumferential shape (outer circumferential surface 801) of the curved-grip part 83. The protrusion of the finger-placement part 86 inclines smoothly in the direction toward the distal-side opening 821. Consequently, a rear-side surface 861 of the finger-placement part 86 has a shape that is smoothly continuous with, but increasingly larger than, the outer circumferential surface 801 of the handle pipe 80. As shown in FIG. 32, the rear-side surface 861 is a portion at which the user's thumb is placed, depending on the manner in which the user U grasps the curved-grip part 83.

The rear-side surface 861 of the finger-placement part 86 has a left-right width that substantially coincides with the outer diameter of the distal-side opening 821, which is shown in FIG. 24. The hook (clip) 87, which extends toward the distal-side opening 821, is connected to the finger-placement part 86, as shown in FIG. 22. That is, the finger-placement part 86 overlaps (extends substantially parallel to) the base-end portion of the hook 87. The hook 87 is provided on the outer circumferential surface 801 of the handle pipe 80 such that it faces downward toward the distal-side opening 821. That is, the hook 87 is formed such that it is capable of hooking (clipping or clasping), from above to below, onto the outer circumferential belt 671, etc., worn by the user U. The hook 87 extends as far as the distal-side opening 821, with the finger-placement part 86 serving as the base-end portion of the hook 87. The protruding part 88, too, is formed having an outer shape that protrudes farther on the lower side than does the outer circumferential shape of the curved-grip part 83. As shown in FIG. 29, the protrusion of the protruding part 88 is located slightly more toward the front side of the curved-grip part 83 than the rear-side surface 861. In addition, the protruding part 88 is preferably designed to protrude by an amount (height) such that the user U feels a slight touch sensation on the index finger when the user U grasps the handle pipe 80.

Similar to the above-described protruding part 88, an upper-side protruding part 89 is provided on the upper side of the curved-grip part 83, as shown in FIG. 22. The upper-side protruding part 89, too, has an outer shape that protrudes farther on the upper side than does the outer circumferential shape (outer circumferential surface 801) of the curved-grip part 83. As shown in FIG. 29, the protrusion of the upper-side protruding part 89 is located on the front side of the hose-connection part 81. In addition, similar to the above-described protruding part 88, the upper-side protruding part 89 is preferably designed to protrude by an amount (height) such that the user U feels a slight touch sensation on the little or pinky finger when the user U grasps the curved-grip part 83.

The hook 87 (the finger-placement part 86) and the protruding part 88, which constitute the expanded parts, are provided on the end portion on which the distal-side opening 821, which is on the lower end of the curved-grip part 83, is disposed. The hook 87 extends from the finger-placement part 86, which constitutes its base-end portion, to an intermediate part 871 and the tip part 872. The intermediate part 871 is tilted (radially inwardly inclined) such that it approaches the outer circumferential surface 801 of the handle pipe 80. The tip part 872 is the terminal end that is distal from the outer circumferential surface 801 of the handle pipe 80. The portion of the hook 87 containing the tip part 872 is elastically deformable, and the finger-placement part 86 of the base-end portion serves as a fixed fulcrum. As shown in FIG. 16, the hook 87 can be hooked (clipped or clasped) onto the outer circumferential belt 671 of a right-hip belt 67 by elastically deforming the tip part 872 away from the pipe-connecting part 82. Furthermore, a stop-bulge part 805 is provided on the outer circumferential surface 801 of the distal-side opening 821, which is distal from the tip part 872 and opposes the hook 87. When the hook 87 has been hooked onto the outer circumferential belt 671 of the right-hip belt 67 or the like, the stopping-bulge part 805 satisfactorily maintains that hooking. It is noted that the hook 87 serves as one representative, non-limiting example of a hook, which is configured to hook (clip), clip or clasp onto a belt or harness worn by the user, according to the present teachings.

FIG. 32 and FIG. 33 illustrate two examples of methods for gripping the handle pipe 80 by hand H. In these figures, symbol H1 denotes the thumb, symbol H2 denotes the index finger, symbol H3 denotes the middle finger, symbol H4 denotes the ring finger, and symbol H5 denotes the little or pinky finger. In addition, symbol H6 denotes the web between the thumb and the index finger, symbols H7 denote the pads of the fingers (fingertips), and symbol H8 denotes the palm. It is noted that the hand H is shown in FIG. 32 as grasping the handle pipe 80 at the intermediate position of the curved-grip part 83. Nevertheless, in other possible gripping methods, the curved-grip part 83 may be grasped such that each of the fingers H2-H5 spans the protruding part 88 on the front side of the curved-grip part 83. Conversely, the curved-grip part 83 may be grasped such that the palm H8 spans the upper-side protruding part 89 on the rear side of the curved-grip part 83. In both of these gripping methods, the protruding part 88 or the upper-side protruding part 89 contacts the hand H and the user U can easily grasp the curved-grip part 83 based on his or her sense of touch.

Figure 18:
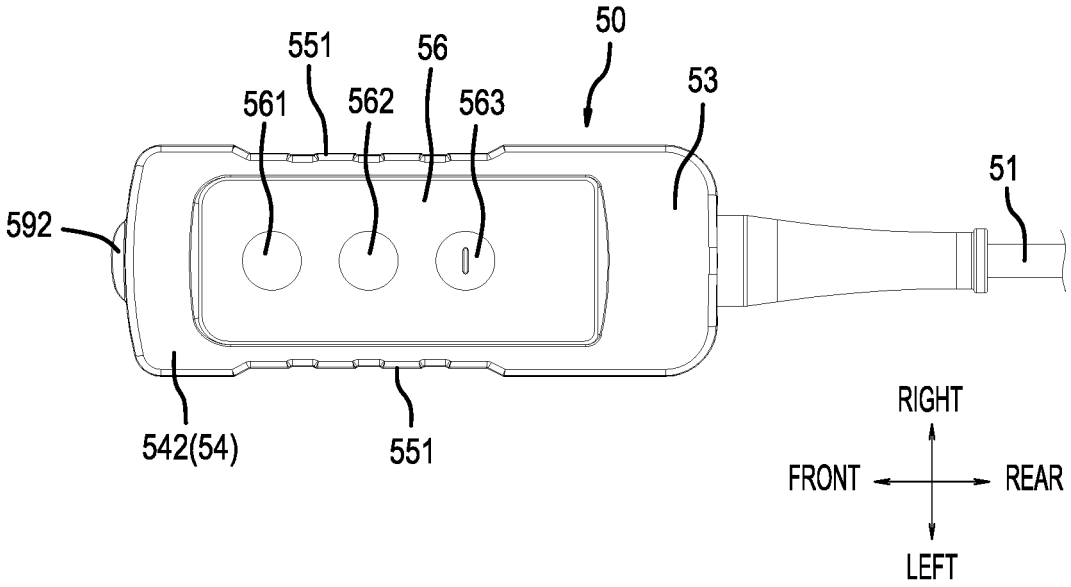
FIG. 18 is a top view of the operation unit.
Figure 19:
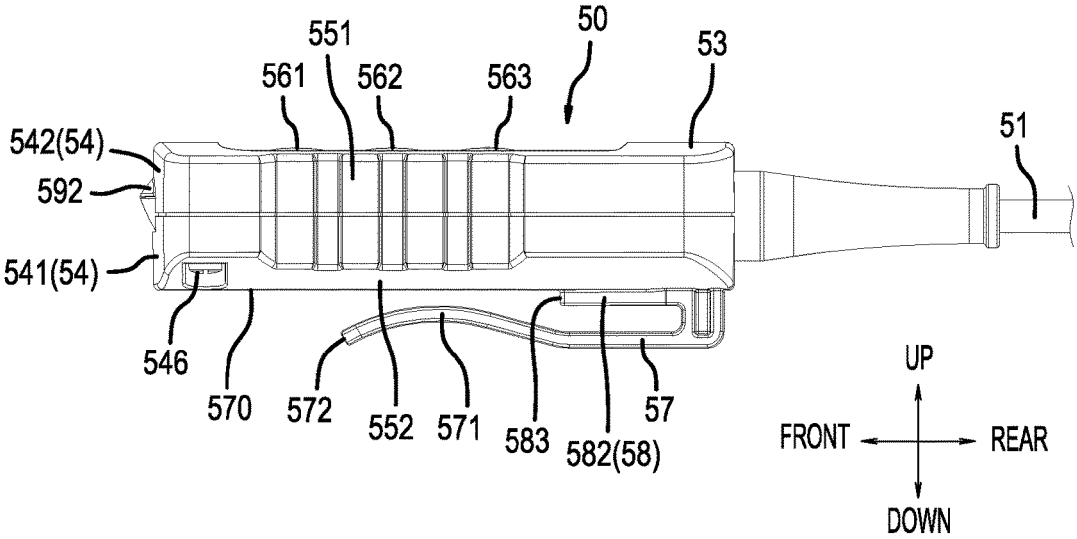
FIG. 19 is a left-side view of the operation unit.
Figure 20:
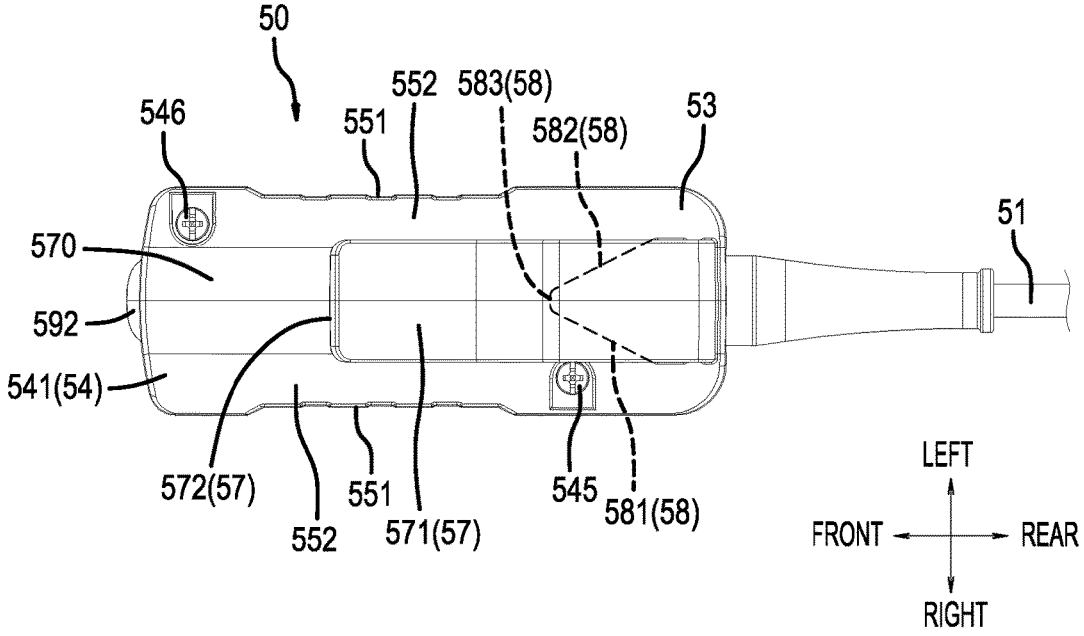
FIG. 20 is a bottom view of the operation unit.

The operation unit (manual selector device) 50 will now be explained with reference to FIGS. 17-21. The operation unit 50 serves as one representative, non-limiting example of an illumination apparatus according to the present teachings. The operation unit 50 may comprise, e.g., the external cord 51 and an operation-unit main body 53. It is noted that the operation-unit main body 53 preferably contains a light (e.g., LED), which serves as one representative example of a light according to the present teachings. As was described above, the external cord 51 is led out from the recessed groove 34 of the midway-intervening part 33 (see e.g., FIG. 12) and is connected to the operation-unit main body 53. Consequently, the operation-unit main body 53 can be designed to input user instructions to the controller 27 via the external cord 51. A housing 54 is formed by the joining a lower-side housing 541 with an upper-side housing 542 by screw fastening the lower-side housing 541 and the upper-side housing 542 using two screws 545, 546. To reduce the number of parts for the screw-fastening, the screw-fastening is provided at two locations: a rear-right position 545 and a front-left position 546, as shown in FIG. 20. It is noted that the external cord 51 serves as one representative, non-limiting example of a flexible, external cord (or simply "cord") according to the present teachings.

With respect to the outer shape of the housing 54, the shape of the grip portion is preferably selected (designed) to facilitate gripping by the hand based on the size of an average palm. Specifically, the housing 54 is formed substantially as a box shape having a front-rear length that matches the size of an average palm. Slip-preventing parts 551, which are slightly indented, are provided on both the left and right sides of the housing 54. The slip-preventing parts 551 are provided in or along the front-rear direction as a continuous shape that is suitably uneven, and thereby reduce slipping when grasped by the user's hand. In addition, bevel parts 552 are provided on a lower surface 570 of the housing 54 to make it easy to grasp with the hand. These bevel parts 552 are formed into shapes that are suitably rounded such that right and left corner edges of the housings 54 are beveled.

A hook (clip) 57 is provided at the center of the lower surface 570. As shown in FIG. 1, the hook 57, too, is configured such that it can be hooked (clipped or clasped), e.g., onto an outer circumferential belt 681 of a left-hip belt 68. As shown in FIGS. 19 and 20, the hook 57 is continuous with and supported by a rear end of the lower surface 570 of the housing 54. Thus, the hook 57, which is supported at its rear end, is formed such that it extends toward the front side. In the hook 57, which thusly extends toward the front side, an intermediate part 571 is curved such that it approaches (is inwardly inclined toward) the lower surface 570 of the housing 54, and a tip part 572 is curved such that it extends (flares) away from the lower surface 570. A tilted-guide part 58 is provided on an inner side of the hook 57 between the lower surface 570 and the hook 57. The tilted-guide part 58 is disposed closer to the rear end than the center of the lower surface 570.

The tilted-guide part 58 is formed such that it protrudes in a step shape from the lower surface 570 toward the hook 57. The step shape of the tilted-guide part 58 has two guide side surfaces 581, 582, which tilt such that they respectively approach the center from the right and left sides as they extend in the direction from the rear to the front. More specifically, as shown in FIG. 20, the right-guide side surface 581 inclined such that, in its extension from the rear to the front, it approaches the center from the right. The left-guide side surface 582 inclined such that, in its extension from the rear to the front, it approaches the center from the left. Both the right-guide side surface 581 and the left-guide side surface 582 approach one another at the center as they extend toward the front, and become mutually continuous (i.e. a point) at a midway vertex 583, which constitutes a midway position in the left-right direction. In other words, the right-guide side surface 581 and the left-guide side surface 582 preferably have the shape of two sides (legs) of an isosceles triangle, although the lengths of the legs and/or their angular relationship may be modified to provide different illumination directions (see below) when the operation unit 50 is hooked onto a belt or harness.

The right and left guide side surfaces 581, 582 are configured such that they contact a belt edge (e.g., 672 or 682) of one of the outer circumferential belts 671, 681 when the hook 57 of the operation unit 50 has been hooked onto the outer circumferential belt (e.g., 671 or 681), which will be further explained below. Thus, when one of the guide side surfaces 581, 582 makes contact with the belt edge (e.g., 672 or 682), the guide side surface 581, 582 guides the operation unit 50 such that a front end of the housing 54 is directed in a forward diagonally downward direction that is tilted with respect to the direction in which the hip belts 67, 68 extend. For example, in the operation unit 50 shown in FIG. 1, when the left-guide side surface 582 makes contact with the belt edge 682 of the outer circumferential belt 681 on the left side, the left-guide side surface 582 causes the front end of the housing 54 to be directed (oriented) in a forward diagonally downward direction that is tilted with respect to the direction in which the left-hip belt 68 extends. Therefore, the illumination of LEDs (light-emitting diodes) 591 located on the front end of the operation unit 50, which will be explained next, can be guided such that the illumination direction is directed in the forward diagonally downward direction. Therefore, the path in front of the user U can be suitably illuminated and it is not necessary for the user U to hold the operation unit 50 in his or her hand while vacuuming, thereby providing a very convenient illumination device for the dust collector 10.

Figure 21:
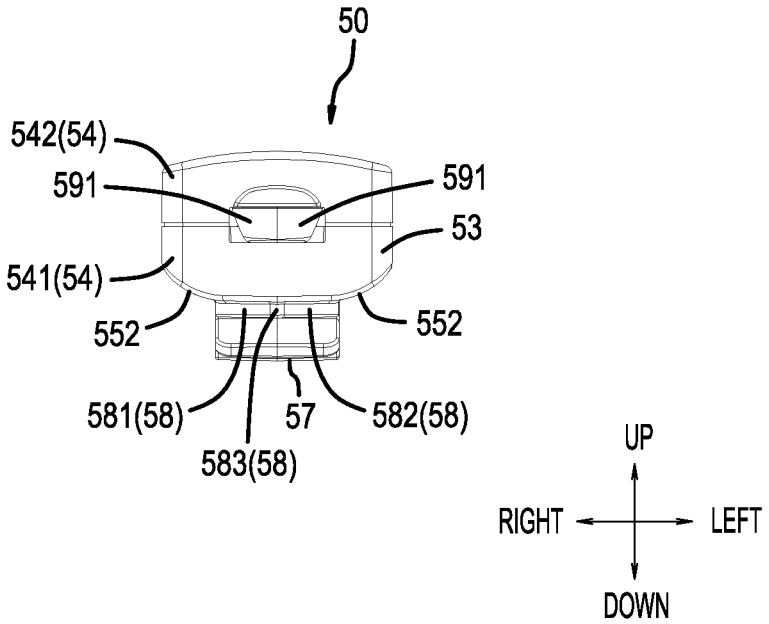
FIG. 21 is a front view of the operation unit.

A (not shown) circuit board is installed in the interior of the housing 54. The circuit board controls the ON/OFF state of the light illumination in accordance with the operation input (inputted instruction) of the user U, inputs ON/OFF operations to the dust-collector main body 11 (i.e. to controller 27) in accordance with the operation input (inputted instruction) of the user U, etc. The circuit board is electrically connected to the external cord 51, which extends from a rear part of the housing 54. In addition, the circuit board has an operation panel 56, which is disposed on an upper surface, for manually inputting user instructions. As shown in FIG. 21, two LEDs 591 are provided on a front part of the circuit board. The LEDs 591 illuminate the exterior through a transmissive (clear) window 592, which is disposed on the front part of the housing 54. The operation panel 56 has three buttons 561, 562, 563 aligned in the front-rear direction, as shown in FIG. 18.

An ON button 561 of the dust-collector main body 11 is configured as the button that is first from the front of the operation panel 56. When the ON button 561 is pressed, an ON instruction is input from the circuit board to the controller 27 of the dust-collector main body 11 via the external cord 51. The ON button 561 serves as one representative, non-limiting example of a switch, for driving (i.e. controlling, or turning ON and OFF) the brushless motor 23, according to the present teachings. In response to receiving an ON signal from the operation unit 50, the controller 27 drives the brushless motor 23 by supplying electric power to the brushless motor 23. An OFF button 562 of the dust-collector main body 11 is configured as the button that is second from the front of the operation panel 56. When the OFF button 562 is pressed, an OFF instruction is input from the circuit board to the controller 27 of the dust-collector main body 11 via the external cord 51. In response to receiving an OFF signal from the operation unit 50, the controller 27 stops the drive of the brushless motor 23 by stopping the supply of electric power to the brushless motor 23. A light-ON/OFF button 563 is configured as the button that is the third from the front of the operation panel 56. The light-ON/OFF button 563 switches the LEDs 591 ON and OFF every time the light-ON/OFF button 563 is pressed. It is noted that the current that powers the LEDs 591 may be supplied from the dust-collector main body 11 via the external cord 51. In an alternative embodiment, one or more batteries may be housed in the interior of the housing 54, and the current that powers the LEDs 591 may be supplied from these batteries.

Figure 8:
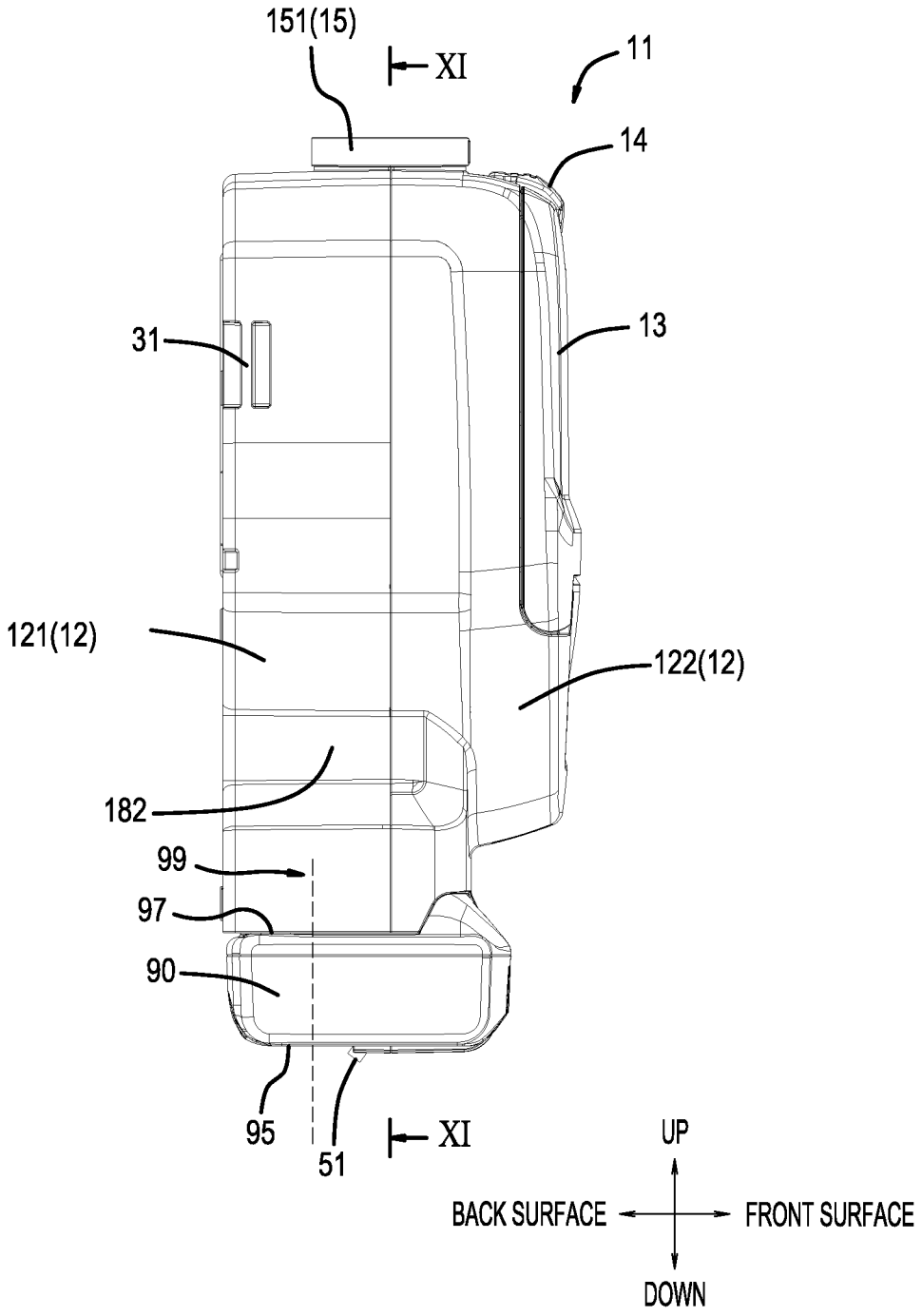
FIG. 8 is a left-side view of the dust-collector main body.
Figure 9:
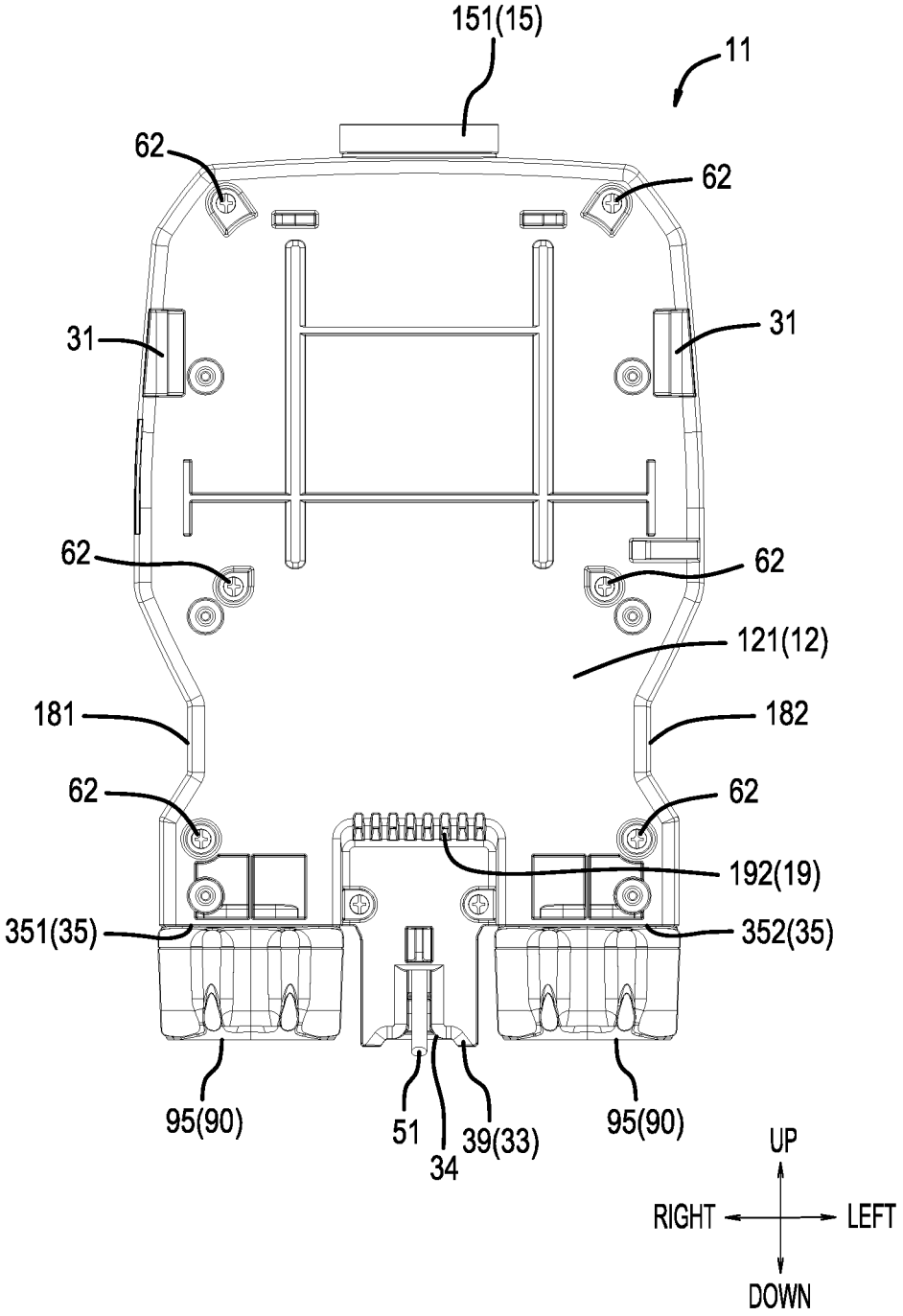
FIG. 9 is a back view of the dust-collector main body.

The belt equipment (harness) 60 will now be explained with reference to FIGS. 1-6, 9 and 16. The belt equipment 60 may be configured in the same manner as belt equipment (back pads, right-shoulder belts, left-shoulder belts, hip belts, and chest belts) that is widely used in backpacks (rucksacks) and the like. That is, the belt equipment 60 preferably may be configured as a belt (harness) that is attached to the dust-collector main body 11 in order to carry the dust-collector main body 11 on one's back. The belt equipment 60 may comprise, e.g., a back pad 61, a right-shoulder belt (strap) 63, a left-shoulder belt (strap) 65, the hip belts 67, 68, and a chest belt (strap) 71. The back pad 61 is a portion of the belt equipment 60 that is coupled to the dust-collector main body 11. Referring to FIG. 9, it is noted that the surface of the back pad 61 on the dust-collector main body 11 side may be screw-fastened to the dust-collector main body 11 at six locations identified by male screws 62. The back pad 61 contacts the back of the user U when the user U carries the dust-collector main body 11 on his or her back. The back pad 61 is formed as a double or padded structure that contains a cushion material (not shown) within a flexible cloth material. The back pad 61 is integrally connected to the various belts, which will be explained next. As shown in FIGS. 8, 9 and 12, belt loops 31 are provided in the housing 12 for holding the belts in place.

The right-shoulder belt 63 is a belt or strap that is intended (configured) to be slung over the user's right shoulder, and the left-shoulder belt 65 is a belt or strap that is intended (configured) to be slung over the user's left shoulder. The right and left shoulder belts 63, 65 form a pair, and one-end side of each of the shoulder belts 63, 65 is connected to the back pad 61. Therefore, when the shoulder belts 63, 65 are slung over both shoulders of the user U, the dust-collector main body 11 can be carried on the user's back. The right-shoulder belt 63 and the left-shoulder belt 65 are also preferably formed so to contain a suitable cushion (padding) material, and one side (end) of each of the right-shoulder belt 63 and the left-shoulder belt 65 is connected to an upper-end portion of the back pad 61. In addition, the other side (end) of each of the right-shoulder belt 63 and the left-shoulder belt 65 is respectively connected to the hip belts 67, 68 via adjustable-belt parts 64, 66. The adjustable-belt parts 64, 66 (641, 661) can adjust, by using adjusters 72, the length of the corresponding belt between the back pad 61 and the hip belts 67, 68. Furthermore, the chest belt 71, which is designed to prevent the shoulder belts 63, 65 from unintentionally coming off of the shoulders during operation, is attached to the right-shoulder belt 63 and the left-shoulder belt 65. The chest belt 71 is configured to be attached to and detached from the shoulder belts 63, 65 and is provided with an adjuster that adjusts the belt length.

Figure 2:
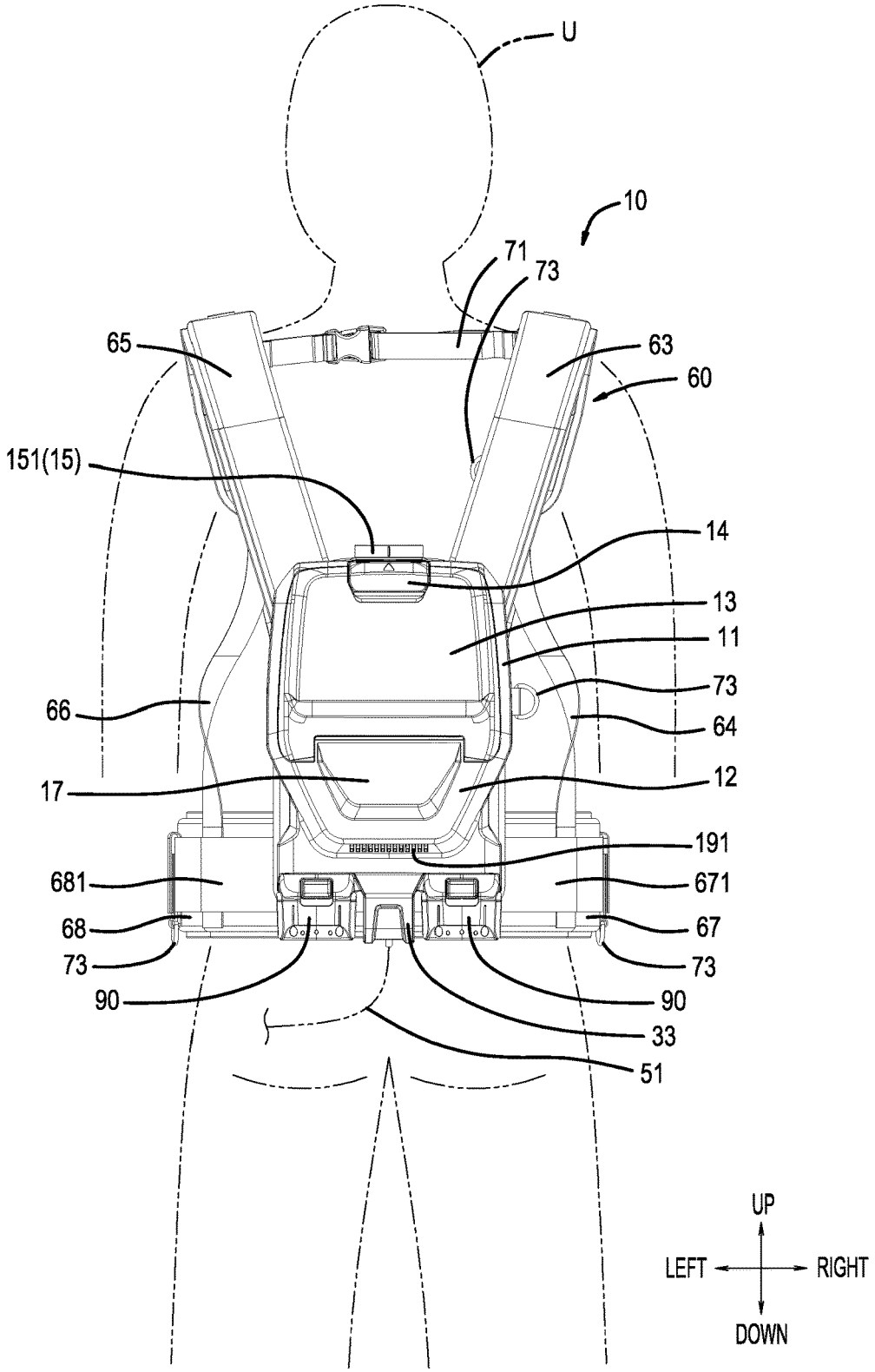
FIG. 2 is an oblique view that shows the dust collector, in a direct-oblique view, while being carried on the user's back.
Figure 3:
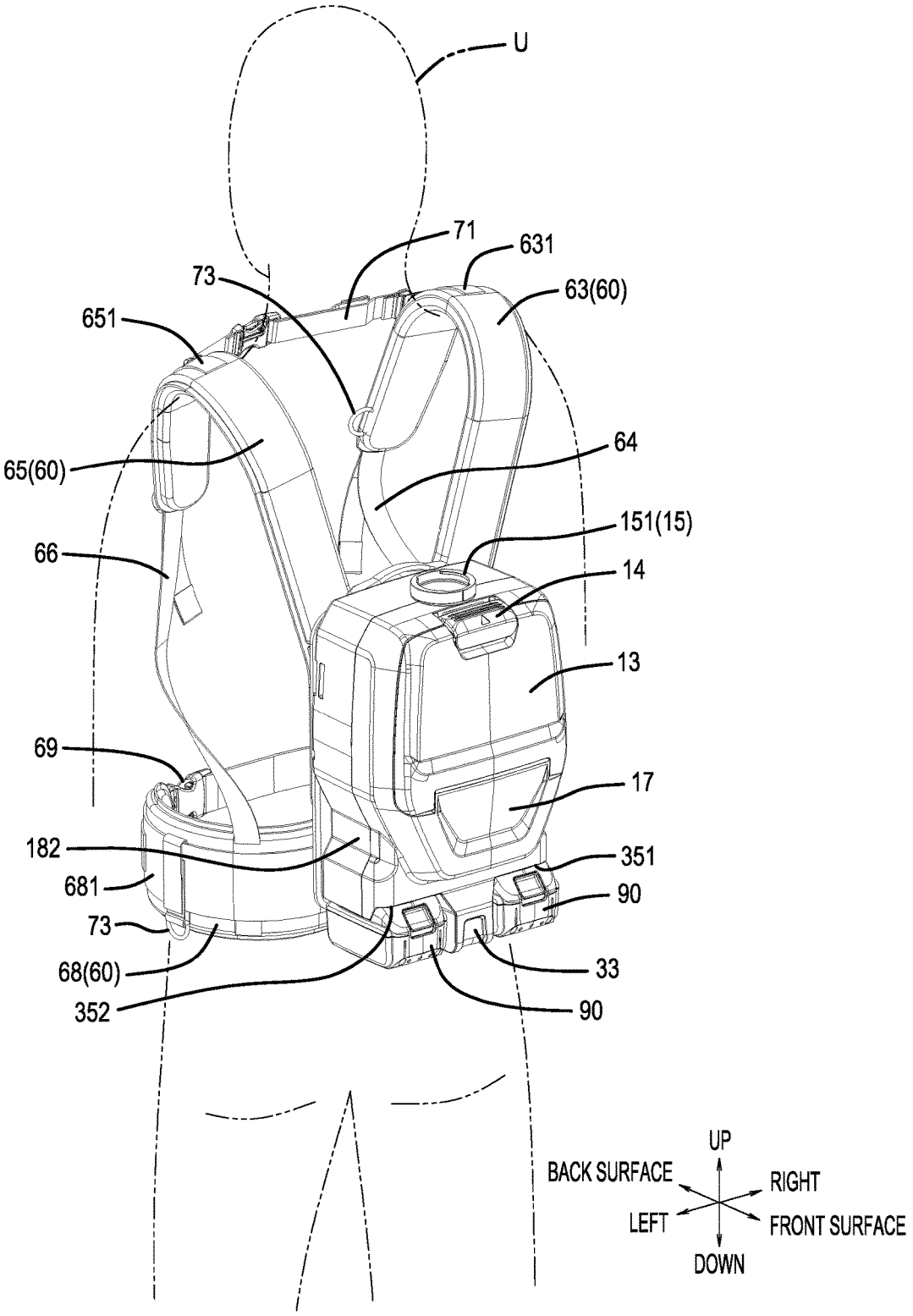
FIG. 3 is a rear view that shows a front surface of the dust collector while being carried on the user's back.
Figure 4:
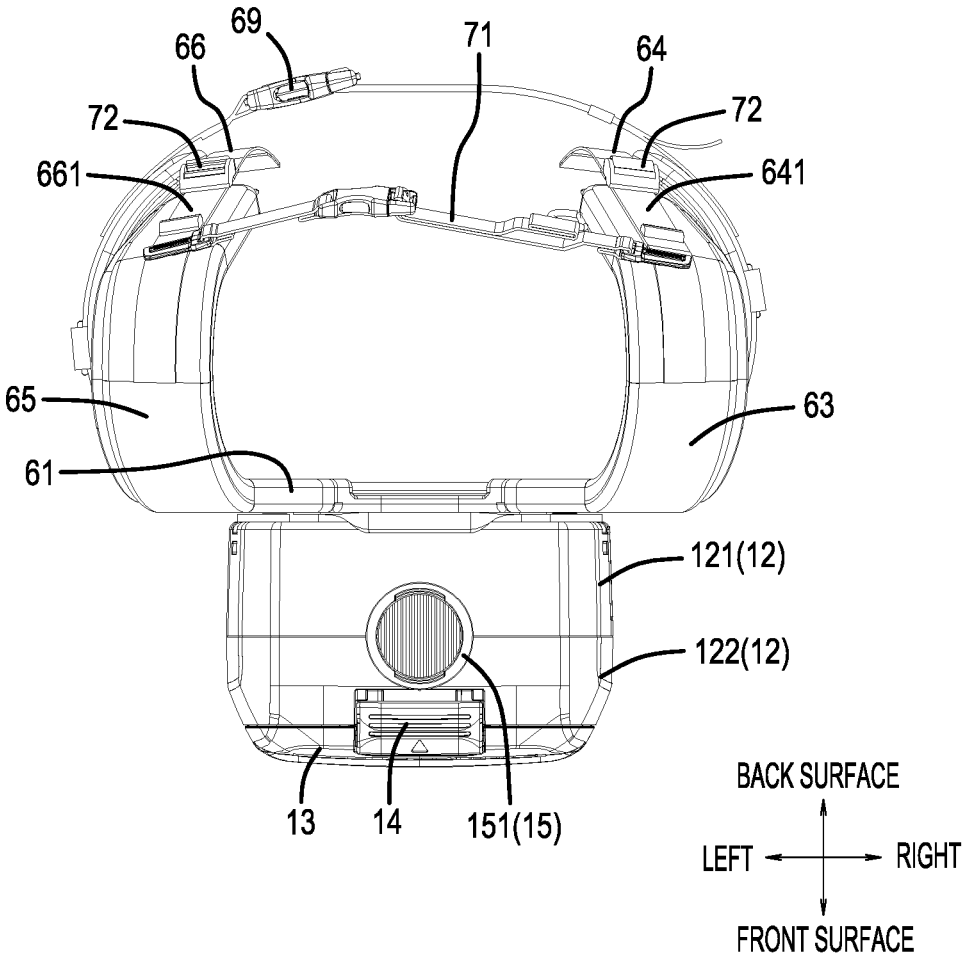
FIG. 4 is a top view that shows an upper surface of the dust collector.
Figure 5:
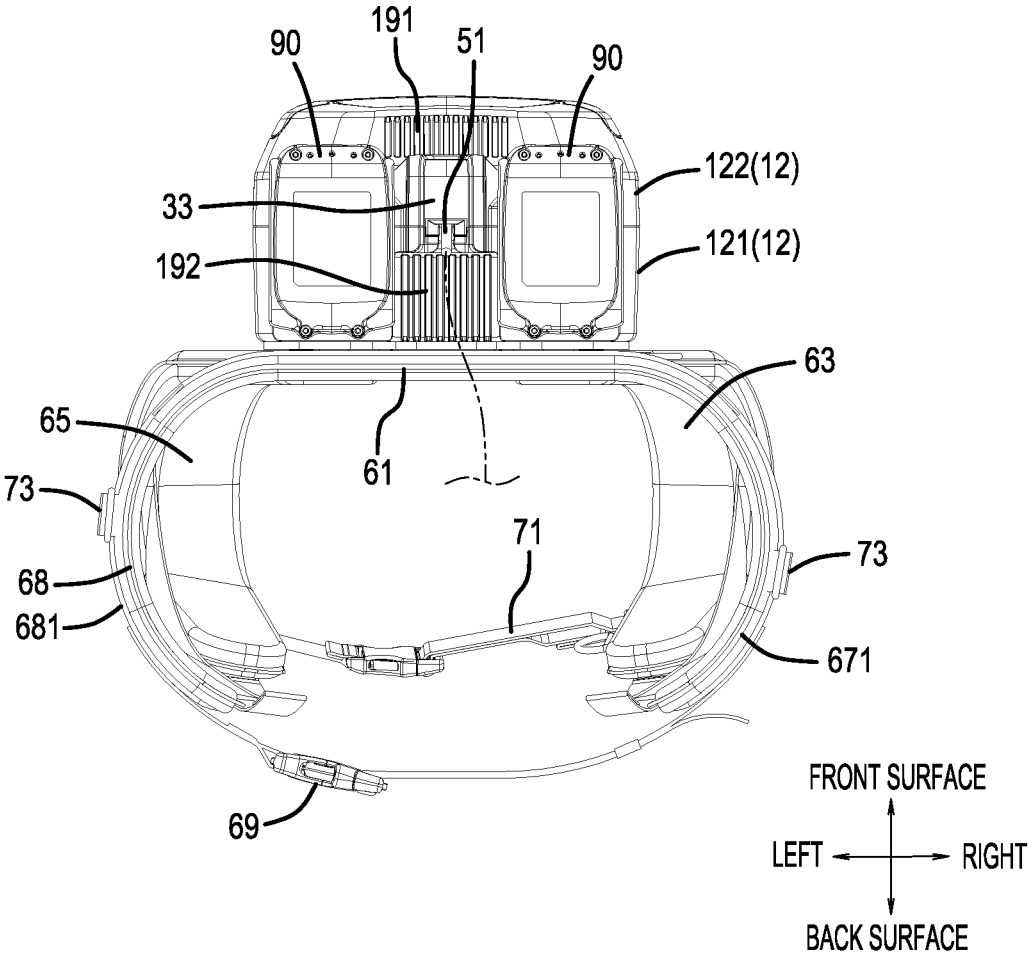
FIG. 5 is a bottom view that shows a lower surface of the dust collector.
Figure 6:
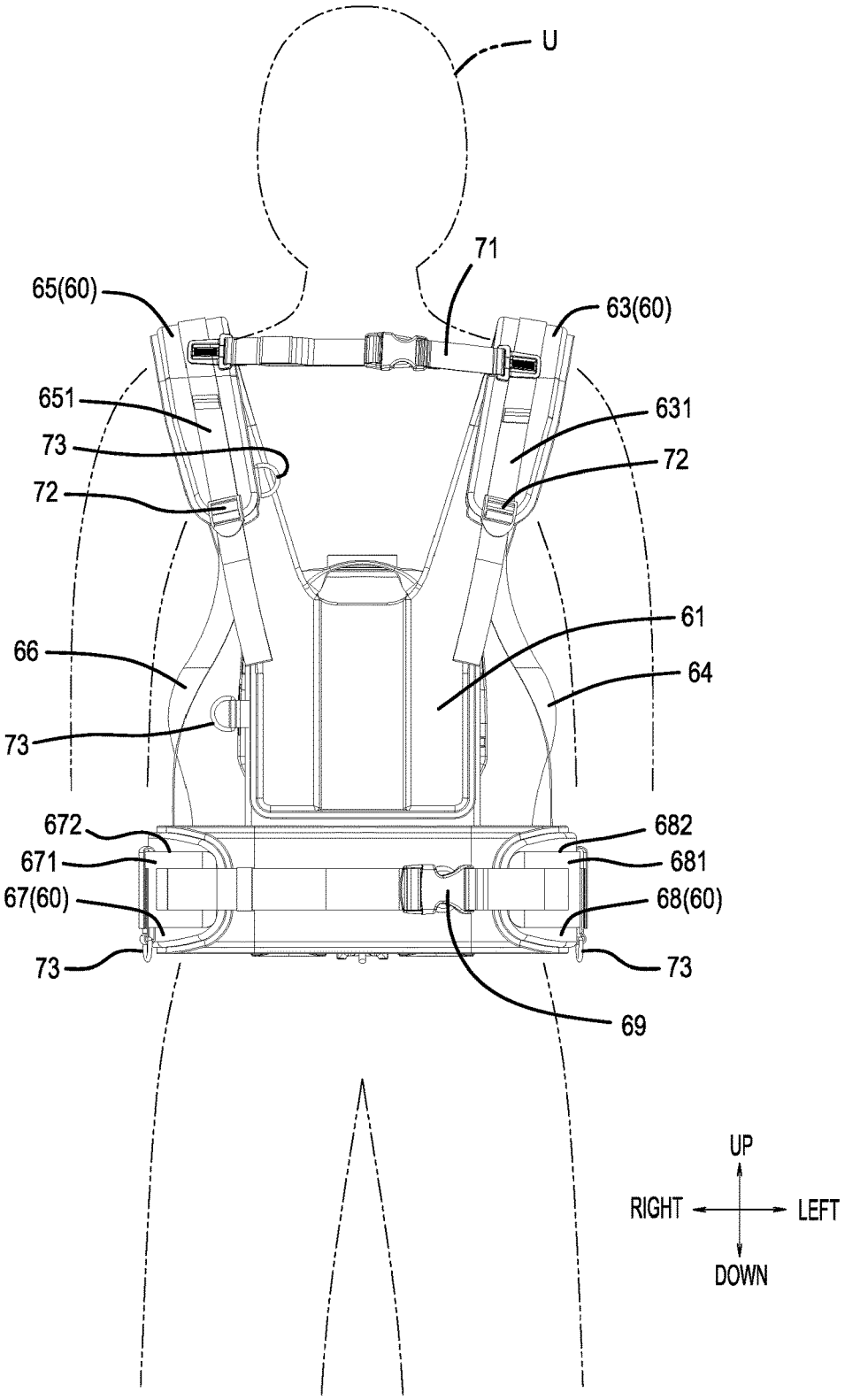
FIG. 6 is a back view that shows portions of shoulder belts that contact the back.
Figure 7:
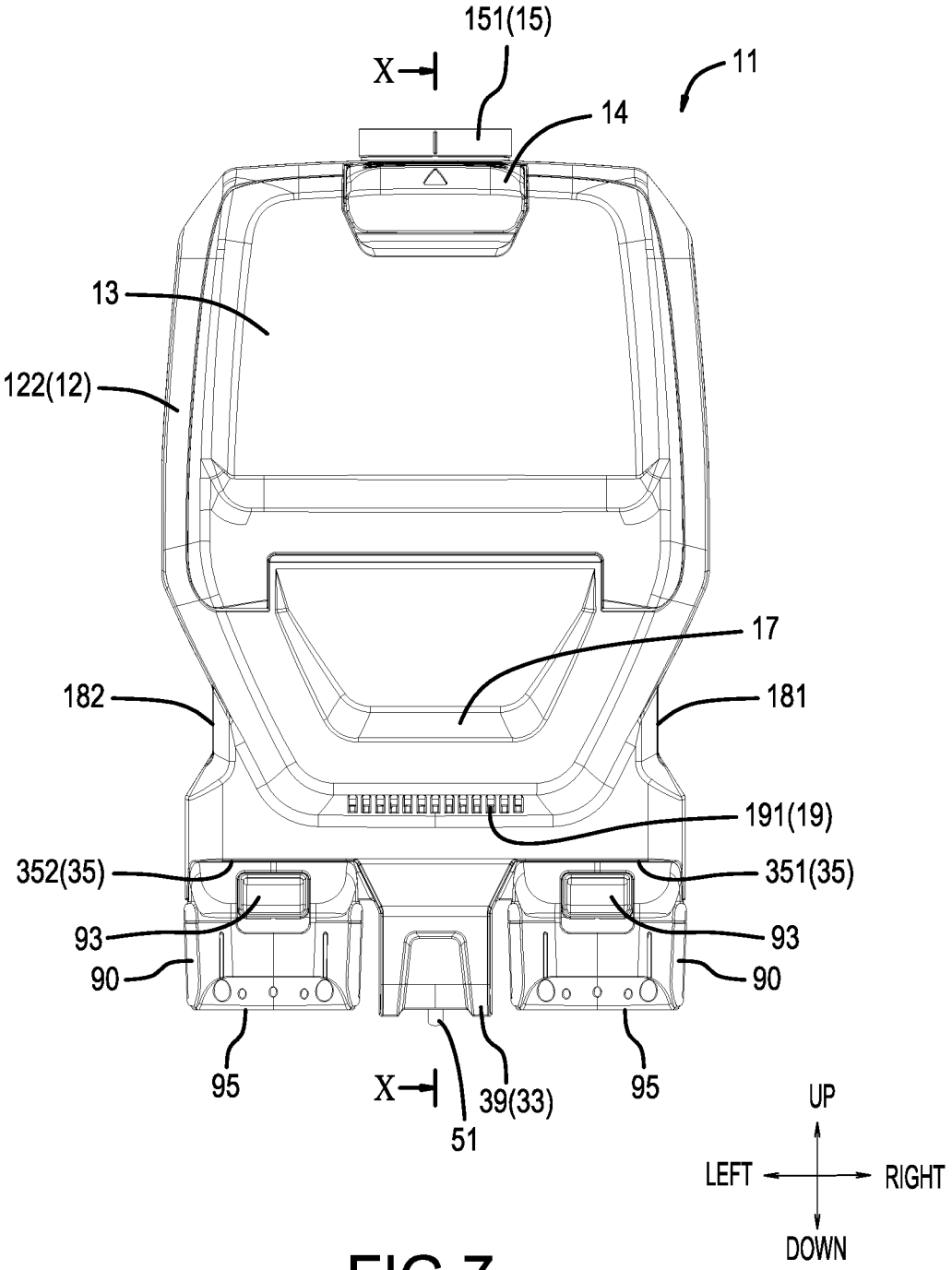
FIG. 7 is a front view of a dust-collector main body.

The right-hip belt 67 is worn around the user's right hip (waist) and is connected to a lower-right part of the back pad 61. The left-hip belt 68 is worn around the user's left hip (waist) and is connected to a lower-left part of the back pad 61. The right-hip belt 67 and the left-hip belt 68 can be fastened to one another via a buckle 69. The buckle 69 also serves as an adjuster for adjusting the belt length and is configured to adjust the length between the right-hip belt 67 and the left-hip belt 68 fastened together. The right-hip belt 67 and the left-hip belt 68 are preferably formed to contain a suitable cushion (padding) material. As shown in FIGS. 2 and 3, D-rings 73 are attached to the belt equipment 60 at suitable locations. The D-rings 73 are configured such that carabiners, hooks, and the like can be attached thereto. In addition, outer circumferential belts 631, 651 are provided on the outer circumferences of the shoulder belts 63, 65, and the outer circumferential belts 671, 681 are likewise provided on the outer circumferences of the hip belts 67, 68. The above-mentioned hook 57 can be kept hooked onto any of the outer circumferential belts 631, 651, 671, 681.

According to the dust collector 10 configured as described above, a high-power brushless motor 23 can be installed in the dust-collector main body 11 that will be carried on both shoulders of the user U via the belt equipment 60. That is, the user U can perform cleaning work (vacuuming) while carrying the dust-collector main body 11 on his or her back. In so doing, the above-mentioned dust collector 10 makes it possible for the user U to perform cleaning work without having to carry a heavy component (canister) by hand while utilizing a high-power motor to clean with high-power suctioning. In addition, the above-described dust collector 10 makes it possible to brightly illuminate a dark location utilizing the operation unit 50. As a result, it is possible to also clean (vacuum) a dark location and, moreover, to utilize various illumination apparatuses in accordance with the application.

In addition, because the battery-mounting parts 35 are disposed at or on the downward portion of the housing 12 in the above-described dust collector 10, the mounted power-tool batteries 90 can be placed or located in or at a downward portion of the housing 12 and thus the overall center-of-gravity position is located in downward or lower portion of the dust collector 10. Thereby, the user's sense of stability can be increased when the dust collector 10 is carried on his or her back. In addition, according to the above-described dust collector 10, because the exhaust slits 19 are provided in the lower part of the housing 12 and the exhaust draft is directed downward, the exhaust draft does not blow toward the user's face. Thereby, an adverse impact of the exhaust draft on the user U can be prevented. According to the above-described dust collector 10, because the external cord 51 is connected to the lower part of the housing 12, the external cord 51 does not become entangled with the housing 12 when the external cord 51 dangles downwardly due to gravity. Such a design prevents the external cord 51 from becoming a hindrance during vacuuming if the operation unit 50 is not hooked onto a belt or harness.

In addition, when the power-tool batteries 90 are to be mounted on the above-described dust collector 10, they are slid from the distal side (the front-surface side) to the proximate side (the rear-surface side) of the user U, who is carrying the dust collector 10 on his or her back. This design enables t the power-tool batteries 90 to be easily and conveniently mounted while the user U is still carrying the dust collector 10 on his or her back. In addition, according to the above-described dust collector 10, the air-suction port 15, which provides a communication path for the dust-containing air into the dust collection chamber 30, is disposed on the upper part of the housing 12. Furthermore, because the controller 27, which controls the brushless motor 23, is disposed in the interior of the housing 12 lined up at the same height position as the brushless motor 23, the length in the up-down direction of the brushless motor 23 and the controller 27 can be reduced. That is, the dust-collector main body 11 can be made compact.

According to the above-described handle pipe 80, the coupling-hose part 40 can be kept hooked onto a belt and thereby fixed by the hook 87. By utilizing the hook 87 in this manner, the coupling-hose part 40 can be disposed in a fixed state relative to the user U in situations, such as if the user U does not want to carry the coupling-hose part 40 by hand, if the coupling-hose part 40 is stored when not in use, and the like, thereby making it convenient for the user U. In addition, according to the above-described handle pipe 80, the hook 87 can be hooked on a belt or harness such that it faces downward toward the distal-side opening 821. Therefore, the intake nozzle 48 (suction port) side, which tends to become dirty, can be kept disposed downward facing, which is advantageous from the standpoint of hygiene.

In addition, according to the above-described handle pipe 80, the curved-grip part 83 is formed into a curved pipe shape, and this curvature makes it possible to ensure ease-of-grip for the user U. In addition, the hook 87 is provided on the upper side of the outer circumferential surface 801 and on the side closest to the distal-side opening 821. Therefore, for example, if the hook 87 is hooked onto the outer circumferential belt 671 of the user's right-hip belt 67, the hook 87 can be kept disposed spaced apart from the user's torso such that the hook 87 does not interfere with the connection hose 42 while the intake nozzle 48 (suction port) side is oriented downward facing.

In addition, according to the above-described handle pipe 80, the hook 87 (the finger-placement part 86) and the protruding part 88, the outer diameters of which are expanded, are provided on the outer circumferential surface 801 of the handle pipe 80, and therefore the fingers can be staid by the hook 87 (the finger-placement part 86) and the protruding part 88 when the user U grasps the handle pipe 80 with his or her hand H. Such a design makes the handle pipe 80 easy for the user U to grasp and manipulate. In addition, according to the above-described handle pipe 80, the hook 87 (the finger-placement part 86) and the protruding part 88 are provided on the distal-side opening 821 side, and therefore the palm H8, the finger H1, and the like are better staid when the user U grasps the handle pipe 80 and changes the orientation on the distal-side opening 821 side, thereby improving ease of operation during cleaning.

In addition, according to the above-described handle pipe 80, the portions, at which the outer diameters of the hook 87 (the finger-placement part 86) and the protruding part 88 are expanded, make contact at the position of the palm H8 and the position of the index finger H2, which enhances the sense of touch when grasped by the hand H. In addition, according to the above-described handle pipe 80, the user U can hold the handle pipe 80 by contacting the flat parts 84 with the pads H7 of the fingers H1, H2, and the ease-of-grip can be ensured such that a variety of user gripping methods are also supported. In addition, according to the above-described handle pipe 80, each of the fingers H2-H5 is better staid when the user U grasps the handle pipe 80 by positioning the palm H8 on the upper side of the curvature.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved dust collectors and methods of making and operating the same.

For example, the configuration of the coupling-hose part 40 is not limited to the above-described embodiments, and can be adapted as appropriate to configurations in accordance with the cleaning site. In addition, the belt equipment 60 can also be adapted to a configuration wherein belts are supplemented or eliminated as appropriate, as long as the dust collector can be carried on the user's body (back).

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Depending on design requirements, exemplary embodiments of the controller 27 of the present disclosure may be implemented in hardware and/or in software. The controller 27 can be configured using a digital storage medium, for example one or more of a ROM, a PROM, an EPROM, an EEPROM, a flash memory, etc., on which electronically readable control signals (program code) are stored, which interact or can interact with one or more programmable hardware components to execute programmed functions.

The (each) programmable hardware component can be formed by a processor, a computer processor (CPU=central processing unit), an application-specific integrated circuit (ASIC), an integrated circuit (IC), a computer, a system-on-a-chip (SOC), a programmable logic element, and/or a field programmable gate array (FGPA). A microprocessor is a typical component of a microcontroller according to the present teachings.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods or functions described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the controller 27, are implemented as a program, firmware, computer program, or computer program product including a program, or as data, wherein the program code or the data is operative to perform one of the methods when the program runs on (is executed by) a processor or a programmable hardware component. The program code or the data can for example also be stored on a machine-readable carrier or data carrier, such as any of the types of digital storage media described above. The program code or the data can be, among other things, source code, machine code, bytecode or another intermediate code.

A program according to an exemplary embodiment can implement one of the methods or function during its performance, for example, such that the program reads storage locations and/or writes one or more data elements into these storage locations, wherein switching operations or other operations are induced in transistor structures, in amplifier structures, or in other electrical, electronic, optical, magnetic components, or components based on another functional or physical principle. Correspondingly, data, values, sensor values, or other program information can be captured, determined, or measured by reading a storage location. By reading one or more storage locations, a program can therefore capture, determine or measure sizes, values, variables, and other information, as well as cause, induce, or perform an action by writing in one or more storage locations, as well as control other apparatuses, machines, and components, and thus for example also perform any complex process that the air compressor may be designed to perform.

Although some aspects of the present teachings have been described in the context of a device or apparatus, it is to be understood that these aspects also represent a description of a corresponding method, so that a block or a component of a device or apparatus is also understood as a corresponding method step or as a feature of a method step. In an analogous manner, aspects which have been described in the context of or as a method step also represent a description of a corresponding block or detail or feature of a corresponding device.

Additional representative, non-limiting examples of the present teachings include:

1. A vacuuming apparatus, comprising:

a housing containing a motor, a suction fan (e.g., a centrifugal fan) rotatably driven by the motor and a dust-collection chamber configured to receive dust and/or particles suctioned when the motor drives the suction fan to generate a partial vacuum within the dust-collection chamber;

at least one battery pack mount disposed on a lower surface the housing and configured to slidably engage a power-tool battery pack having guide rails; and a harness attached to the housing and comprising two shoulder belts and a waist belt configured to enable a user to carry the housing on the user's back.

2. The vacuuming apparatus according to embodiment 1, wherein the at least one battery pack mount is disposed on a lower surface the housing, as determined in the orientation of the housing when the housing is carried on the user's back.

3. The vacuuming apparatus according to embodiment 1 or 2, further comprising:

an air-exhaust port defined in a lower part of the housing and being configured to downwardly direct an exhaust draft generated by the suction fan when driven by the motor.

4. The vacuuming apparatus according to any preceding embodiment, further comprising:

an ON/OFF switch electrically connected to the motor (e.g., via a controller) via a flexible, external cord;

wherein one end of the cord is physically connected to a (the) lower part of the housing.

5. The vacuuming apparatus according to any preceding embodiment, wherein:

the housing has: a rear-surface side, which is proximate to the user's back when the vacuuming apparatus is being carried on the user's back; and a front-surface side, which is opposite of the rear-side surface; and the at least one battery pack mount is configured to slidably receive the power-tool battery pack by sliding the power-tool battery pack in the direction from the front-surface side to the rear-surface side of the housing.

6. The vacuuming apparatus according to any preceding embodiment, further comprising:

an air-suction port defined in an upper part of the housing, the air-suction port being configured to fluidly communicate outside air, including any dust and/or particles contained therein, into the dust-collection chamber; and/or a controller disposed in the interior of the housing at the same height position as the motor, the controller being electrically connected to, and configured to, control operation of the motor.

7. The vacuuming according to any preceding embodiment, further comprising:

a manual selector device having an (the) ON/OFF switch and a light electrically connected to a (the) controller via an (the) external, flexible cord, wherein the manual selector device optionally has a hook or clip configured to be clipped on the harness (e.g., the waist belt) such that the light illuminates in a forward downward diagonal direction of the user when the vacuuming according is carried on the user's back.

8. The vacuuming apparatus according to any preceding embodiment, further comprising:

a flexible hose having a first end that is detachably connected to an (the) air-suction port defined in the housing, the flexible hose being in fluid communication with the dust-collection chamber; and a hollow wand handle detachably connected to a second end of the flexible hose;

wherein a first end of a (hollow) wand, such as an extension wand or telescoping wand, is optionally connected to the hollow wand handle, and a second end of the (hollow) wand is optionally configured to mount a vacuuming attachment, such as a floor nozzle, a crevice tool, an upholstery tool, a brush, etc.

9. The vacuuming apparatus according to embodiment 8, wherein the hollow wand handle includes a first circumferential surface portion having a first outer diameter and a second circumferential surface portion having a second outer diameter that is larger than the first outer diameter.

10. The vacuuming apparatus according to embodiment 9, wherein:

the first circumferential surface portion and the second circumferential surface portion are curved along an axial direction of the hollow wand handle; and the first circumferential surface portion is disposed between the flexible hose and the second circumferential surface portion.

11. The vacuuming apparatus according to embodiment 9 or 10, wherein the second circumferential surface portion contains a first raised portion disposed opposite of a second raised portion in a direction perpendicular to the axial direction of the hollow wand handle.

12. The vacuuming apparatus according to any one of embodiments 8-11, wherein the hollow wand handle includes a first flat portion positioned to contact a pad of a finger when the hollow wand handle is grasped by hand.

13. The vacuuming apparatus according to embodiment 12, wherein:

the hollow wand handle is curved along a portion of its axial direction;

the first flat portion is disposed opposite of a second flat portion in a direction perpendicular to an axial direction of the hollow wand handle;

the first flat portion is positioned to contact a pad of a thumb and the second flat portion is positioned to contact a pad of an index finger when the hollow wand handle is grasped by hand; and the first and second flat portions are disposed within the curved portion of the hollow wand handle.

14. The vacuuming apparatus according to any one of embodiments 8-13, further comprising a hook or clip disposed on a circumferential surface of the hollow wand handle.

15. The vacuuming apparatus according to embodiment 14, wherein the hook or clip is arranged on the hollow wand handle such that a terminal end of the hook is directed toward an intake end of the hollow wand handle that is axially opposite of an exhaust end of the hollow wand handle that is coupled to the flexible hose.

16. The vacuuming apparatus according to embodiment 14 or 15, wherein:

the hollow wand handle is curved along a portion of its axial direction;

the hook is disposed on an outer-circumference side of the curve; and a tip of the hook is disposed closer to the intake end of the hollow wand handle than an exhaust end of the hollow wand handle.

17. The vacuuming apparatus according to any preceding embodiment, wherein the vacuuming apparatus does not comprise the harness.

18. An apparatus, comprising:

a battery pack;

a motor driven by current supplied from the battery;

a belt attached to the battery pack and motor and configured to carry the battery pack and the motor on a user's back; and a light powered by current supplied from the battery pack.

19. The apparatus according to embodiment 18, wherein:

the light is connected, via a flexible cord, to a lower part of a housing attached to the belt, the motor being contained in the housing; and the light has a hook configured to be clipped on the belt such that the light illuminates in a forward downward diagonal direction of the user when the apparatus is worn on the user's back.

20. A dust collector, comprising:

a housing containing a motor and a dust-collection chamber;

a harness attached to the housing and being configured so that the housing can be carried on a user's back, the harness comprising a waist belt and optionally one or two shoulder belts (straps);

a flexible hose fluidly connected with the dust-collection chamber;

a hollow wand handle fluidly connected with the flexible hose; and a hook or clip disposed on a circumferential surface of the hollow wand handle, the hook being configured to hook, clip or clasp onto the harness.

21. The dust collector according to embodiment 20, wherein the hook is arranged on the hollow wand handle such that a terminal end of the hook is directed toward an intake end of the hollow wand handle that is axially opposite of an exhaust end of the hollow wand handle that is coupled to the flexible hose.

22. The dust collector according to embodiment 20 or 21, wherein:

the hollow wand handle is curved along a portion of its axial direction; and the hook is disposed on an outer-circumference side of the curve;

a tip of the hook is disposed closer to the intake end of the hollow wand handle than the exhaust end of the hollow wand handle.

23. The dust collector according to embodiment 20, 21 or 22, further comprising:

a light connected to a lower part of the housing via an external flexible cord, wherein the light has a hook or clip configured to be hooked, clipped or clasped on the harness (e.g., the waist belt) such that the light illuminates in a forward downward diagonal direction of the user when the dust collector is carried on the user's back.

24. The dust collector according to any one of embodiments 20-23, further comprising:

a manual selector device connected to a (the) lower part of the housing via an (the) external device, the manual selector device having an ON/OFF switch configured to control operation of the motor.

25. The dust collector according to embodiment 24, wherein the manual selector device includes a (the) light for illuminating an area to be cleaned by the dust collector.

EXPLANATION OF THE REFERENCE NUMBERS

10 Dust collector (vacuum cleaner)
11 Dust-collector main body (back-carried apparatus)
12 Housing (canister)
121 Rear-side housing
122 Front-side housing
13 Open/close cover
131 Lower-side edge
132 Upper-side edge
14 Latching structure
141 Hook
142 Female-hook part
15 Air-suction port
151 Coupling flange
152 Convex part
16 Opening
161 Gasket
162 Filter
17 Front-surface recessed part
181 Right recessed part
182 Left recessed part
19 Exhaust slit (air-exhaust port)
191 First exhaust slit
192 Second exhaust slit
21 Drive part
23 Brushless motor
231 Motor case
232, 233 Screw-fastening parts
234 Screw
24 Rotary-drive shaft
25 Suction fan
251 Fan guide
252 First rubber member
253 Second rubber member
27 Controller
271 Controller case
272 Circuit board
273 Capacitor
281 First sound-insulating member
282 Second sound-insulating member
283 First filter
284 Second filter
29 Power-supply pathway
30 Dust-collection chamber
31 Belt loop
32 Screw
33 Midway-intervening part
34 Recessed groove
35 Battery-mounting part (battery-holding part)
351 Right-battery-mounting part
352 Left-battery-mounting part
36 Sliding-guide part
37 Slide-connection terminal
38 Female-hook part
39 Lower surface
40 Coupling-hose part (hose part)
42 Connection hose (flexible hose)
421 Base-end connection part
422 Tip-connection part
423 Mating-convex part
43 Coupling nozzle
47 Telescoping pipe (extension wand)
471 Base-end connection part
48 Intake nozzle (vacuum attachment)
50 Operation unit (illumination apparatus—manual selector device)
51 External cord
53 Operation-unit main body)
54 Housing
541 Lower-side housing
542 Upper-side housing
545, 546 Screws
551 Slip-preventing part
552 Bevel part
56 Operation panel
561 ON button

562 OFF button
563 Light-ON/OFF button
57 Hook
570 Lower surface
571 Intermediate part
572 Tip part
58 Tilted-guide part
581 Right-guide side surface
582 Left-guide side surface
583 Midway vertex
591 LED (light)
592 Transmissive window
60 Belt equipment (harness)
61 Back pad
63 Right-shoulder belt
65 Left-shoulder belt
64, 66 Adjustable-belt part
67 Right-hip belt
68 Left-hip belt
631, 651, 671, 681 Outer circumferential belts
682 Belt edge
69 Buckle
71 Chest belt
72 Adjuster
73 D-ring
80 Handle pipe (handle-pipe part—hollow wand handle)
801 Outer circumferential surface
805 Stopping-bulge part
81 Hose-connection part
811 Base-side opening
813 Mating hole
82 Pipe-connecting part
821 Distal-side opening
83 Curved-grip part
831 Gently arcuate part
833 Sharply arcuate part
835 Left-side linking part
837 Right-side linking part
84 Flat part
841 Step
85 Bulge part
86 Finger-placement part (expanded part)
861 Rear side surface
87 Hook
871 Intermediate part
872 Tip part
88 Protruding part (expanded part)
89 Upper-side protruding part
90 Power-tool battery
91 Sliding-guide part
93 Male-hook part
95 Lower surface
U User
H Hand

The invention claimed is:

1. A dust collector, comprising:

a housing containing a motor and a dust-collection chamber configured to hold dust collected when the motor is driven, the housing further including a rear-surface side, which is configured to face a back side of a user when the housing is being carried on the user's back, a front-surface side, which is distal from the rear-surface side, and a bottom-surface side extending between the front-surface side and the rear-surface side;

a first battery-holding part provided on the bottom-surface side of the housing, the first battery-holding part having an opening at the front surface side configured to receive a power-tool battery pack;

a first battery pack mounted on the first battery-holding part, the first battery pack having a top side, a bottom side opposite the top side, a connector disposed on the top side and configured to slidably engage the first battery-holding part; and shoulder belts directly or indirectly attached to the housing and configured to be slung over both shoulders of a user in order to carry the housing on the user's back, wherein an imaginary line perpendicular to the bottom side of the first battery pack extends in a first direction from the top side of the first battery pack into the housing and extends in a second direction opposite the first direction from the bottom side of the first battery pack without intersecting any portion of the dust collector, wherein the first battery-holding part is configured to slidably engage the battery pack by sliding the first battery pack in a direction from the front-surface side to the rear-surface side of the housing.

2. The dust collector according to claim 1, further comprising:

an air-exhaust port defined in a lower part of the housing and being configured to downwardly direct an exhaust draft generated by the motor.

3. The dust collector according to claim 1, further comprising:

an ON/OFF switch electrically connected to the motor via an external, flexible cord; wherein one end of the cord is physically connected to a lower part of the housing.

4. The dust collector according to claim 1, further comprising:

an air-suction port defined in an upper part of the housing, the air-suction port being configured to fluidly communicate outside air, including dust, into the dust-collection chamber; and a controller disposed in the interior of the housing at the same height position as the motor, the controller being electrically connected, and configured, to control operation of the motor.

5. The dust collector according to claim 1, further comprising:

a flexible hose fluidly connected with the dust-collection chamber; and a hollow wand handle fluidly connected with the flexible hose;

wherein the hollow wand handle includes a first circumferential surface portion having a first outer diameter and a second circumferential surface portion having a second outer diameter that is larger than the first outer diameter.

6. The dust collector according to claim 5, wherein:

the first circumferential surface portion and the second circumferential surface portion are curved along an axial direction of the hollow wand handle; and the first circumferential surface portion is disposed between the flexible hose and the second circumferential surface portion.

7. The dust collector according to claim 6, wherein the second circumferential surface portion contains a first raised portion disposed opposite of a second raised portion in a direction perpendicular to the axial direction of the hollow wand handle.

8. The dust collector according to claim 1, further comprising:

a flexible hose fluidly connected with the dust-collection chamber; and a hollow wand handle fluidly connected with the flexible hose;

wherein the hollow wand handle includes a first flat portion positioned to contact a pad of a finger when the hollow wand handle is grasped by hand.

9. The dust collector according to claim 8, wherein:

the hollow wand handle is curved along a portion of its axial direction;

wherein the first flat portion is disposed opposite of a second flat portion in a direction perpendicular to an axial direction of the hollow wand handle;

the first flat portion is positioned to contact a pad of a thumb and the second flat portion is positioned to contact a pad of an index finger when the hollow wand handle is grasped by hand; and the first and second flat portions are disposed within the curved portion of the hollow wand handle.

10. The dust collector according to claim 1, further comprising:

a light powered by current supplied from the battery pack.

11. The apparatus according to claim 10, wherein:

the light is connected, via a flexible cord, to a lower part of a housing that is attached to the belt, the housing containing the motor; and the light has a hook configured to be clipped on the belt such that the light illuminates in a forward downward diagonal direction of the user when the apparatus is carried on the user's back.

12. The dust collector according to claim 1, further comprising:

a flexible hose fluidly connected with the dust-collection chamber;

a hollow wand handle fluidly connected with the flexible hose; and a hook disposed on a circumferential surface of the hollow wand handle.

13. The dust collector according to claim 12, wherein the hook is arranged on the hollow wand handle such that a terminal end of the hook is directed toward an intake end of the hollow wand handle that is axially opposite of an exhaust end of the hollow wand handle that is coupled to the flexible hose.

14. The dust collector according to claim 1, wherein the housing and the first battery pack are configured such that the lower surface of the first battery pack forms at least a first portion of a base for supporting the dust collector in an upright configuration when the lower surface of the first battery pack is placed on a support surface.

15. The dust collector according to claim 14, further including:

a second battery-holding part provided on the bottom-surface side of the housing, the second battery-holding part having an opening at the front surface side configured to receive a second battery pack, the second battery pack having a top surface, a lower surface opposite the top surface, a connector disposed on the top surface and configured to slidably engage the second battery-holding part, wherein:

the second battery-holding part is configured to slidably engage the second battery pack by sliding the second battery pack in the direction from the front-surface side to the rear-surface side of the housing, the first battery pack is spaced from the second battery pack in a direction perpendicular to the direction from the front-surface side to the rear-surface side of the housing, and the lower surface of the second battery pack forms a second portion of the base.

16. The dust collector according to claim 15, further including a projection on the bottom-surface side of the housing, the projection having a bottom side that forms a third portion of the base.

17. The dust collector according to claim 16, wherein the projection is located between the first battery pack and the second battery pack.

18. The dust collector according to claim 14, further including a projection on the bottom-surface side of the housing, the projection having a bottom side that forms a second portion of the base.

19. The dust collector according to claim 1, wherein the connector disposed on the top side of the first battery pack includes an electrical connector.

* * * * *